US008418391B2

(12) United States Patent
Kemmerer et al.

(10) Patent No.: US 8,418,391 B2
(45) Date of Patent: Apr. 16, 2013

(54) FIREARM SAFETY LOCK

(75) Inventors: Jason Kemmerer, Thousand Oaks, CA (US); Yishai Mendelsohn, San Diego, CA (US); Clinton D Cope, San Francisco, CA (US)

(73) Assignee: Intelligun, LLC

( * ) Notice: Subject to any disclaimer, the term of this patent is extended or adjusted under 35 U.S.C. 154(b) by 110 days.

(21) Appl. No.: 13/187,435

(22) Filed: Jul. 20, 2011

(65) Prior Publication Data

US 2013/0019512 A1 Jan. 24, 2013

(51) Int. Cl.
*F41A 17/56* (2006.01)

(52) U.S. Cl.
USPC ..... 42/70.05

(58) Field of Classification Search ..... 42/70.01, 42/70.05, 70.11; 89/27.12
See application file for complete search history.

(56) References Cited

U.S. PATENT DOCUMENTS

| | | | | | |
|---|---|---|---|---|---|
| 4,136,475 | A * | 1/1979 | Centille | 42/70.11 |
| 4,467,545 | A * | 8/1984 | Shaw, Jr. | 42/70.01 |
| 4,563,827 | A * | 1/1986 | Heltzel | 42/70.01 |
| 4,682,435 | A * | 7/1987 | Heltzel | 42/70.01 |
| 4,763,431 | A * | 8/1988 | Allan et al. | 42/70.11 |
| 5,090,147 | A | 2/1992 | Pastor | |
| 5,448,847 | A * | 9/1995 | Teetzel | 42/70.11 |
| 5,461,812 | A * | 10/1995 | Bennett | 42/70.11 |
| 5,903,994 | A | 5/1999 | Tange | |
| 5,946,840 | A * | 9/1999 | Mickel | 42/70.11 |
| 6,237,271 | B1 * | 5/2001 | Kaminski | 42/70.06 |
| 6,293,039 | B1 * | 9/2001 | Fuchs | 42/70.11 |
| 6,321,478 | B1 | 11/2001 | Klebes | |
| 6,343,140 | B1 | 1/2002 | Brooks | |
| 6,363,647 | B2 * | 4/2002 | Kaminski | 42/70.11 |
| 6,415,702 | B1 | 7/2002 | Szabo et al. | |
| 6,438,886 | B1 * | 8/2002 | Neumann | 42/70.11 |
| 6,442,880 | B1 * | 9/2002 | Allan | 42/70.08 |
| 6,487,804 | B1 * | 12/2002 | Petrella, Jr. | 42/70.11 |
| 6,510,639 | B2 * | 1/2003 | McMoore | 42/70.06 |
| 6,785,995 | B2 | 9/2004 | Herzog et al. | |
| 6,941,692 | B1 * | 9/2005 | Krinke et al. | 42/70.08 |
| 7,631,452 | B1 | 12/2009 | Brundula et al. | |
| 7,698,845 | B2 | 4/2010 | Hochstrate et al. | |
| 7,707,229 | B2 | 4/2010 | Parhofer et al. | |
| 7,757,420 | B1 * | 7/2010 | Corsaro et al. | 42/70.01 |
| 2001/0016999 | A1 | 8/2001 | Williams | |
| 2001/0032405 | A1 * | 10/2001 | Kaminski | 42/70.05 |
| 2003/0136043 | A1 * | 7/2003 | Lauster et al. | 42/70.11 |
| 2004/0031180 | A1 | 2/2004 | Ivanov | |
| 2007/0119087 | A1 * | 5/2007 | Corsaro et al. | 42/70.01 |

(Continued)

FOREIGN PATENT DOCUMENTS

WO WO 03/098537 11/2003

*Primary Examiner* — Bret Hayes
(74) *Attorney, Agent, or Firm* — Stetina Brunda Garred & Brucker

(57) ABSTRACT

A lock for a firearm with a grip safety, and a sear engageable to a biased hammer in a cocked position and releasable by a trigger is disclosed. The lock has a housing defining a first bore within which a mainspring that biases the hammer is received, as well as a second bore. There is a locking pin retractable into and extendible out of the second bore of the housing. When the locking pin is in an extended position, the grip safety is restricted to an engaged state, blocking movement of the trigger. An actuator disposed in the housing and cooperatively linked to the locking pin provides the motive force for retracting and extending the locking pin.

16 Claims, 15 Drawing Sheets

U.S. PATENT DOCUMENTS

2008/0216376 A1* 9/2008 Pikielny ..... 42/70.11
2010/0162607 A1* 7/2010 Corsaro et al. ..... 42/70.01
2011/0061280 A1* 3/2011 Emde et al. ..... 42/70.06
2012/0291327 A1* 11/2012 Boutot, Jr. ..... 42/70.11

* cited by examiner

FIREARM SAFETY LOCK

CROSS-REFERENCE TO RELATED APPLICATIONS

The present application relates to the concurrently filed co-pending application entitled "FIREARM LOCKING SYSTEM," the disclosure of which is expressly incorporated by reference in its entirety herein.

STATEMENT RE: FEDERALLY SPONSORED RESEARCH/DEVELOPMENT

Not Applicable

BACKGROUND

1. Technical Field

The present disclosure relates generally to firearms and biometric systems, and more particularly to a firearm safety system that locks and prevents the operation of a firearm without valid biometric credentials. The present disclosure also relates to firearm locks that prevent the disengagement of safeties.

2. Related Art

Firearms are valuable tools that are commonly utilized for many legitimate purposes by civilians, military, and police alike. Chief among these purposes is personal defense, as firearms greatly level the field and equalize inherent power imbalances typical between criminal and potential victims. With the simple press of the trigger, for example, a weaker individual can thwart a much stronger, physically imposing criminal. Oftentimes, the mere presentation of the firearm is all that is necessary to stop the threat. According to some studies, it has been estimated that there are over 2.5 million defensive uses of firearms per year. These include incidents where no shots were fired. Police regularly deploy firearms to save the lives of others, as do the military to defend and ensure the safety the nation.

Besides defensive purposes, many firearms are kept for recreational and sporting purposes. Learning and practicing marksmanship, at times in informal ways (plinking) is regarded as somewhat of a national pastime. Furthermore, sanctioned competitive shooting events that emphasize speed, movement and marksmanship, going beyond the experience possible with static shooting ranges, attract many participants at the local, regional, and national levels. More traditional uses of firearms for hunting various game animals for sport and sustenance continues to be popular, and is an important aspect of implementing conservation policies. In addition to marksmanship, hunting is appreciated for the valuable outdoor survival skills it teaches, and for fostering an attitude of self-sufficiency and self-reliance.

Ownership of firearms and participation in activities that involve firearms are deeply ingrained in the culture of the United States. Firearms have played a crucial role in many significant points throughout its history from its founding to the present day, and are deserving of its venerated status in the country's heritage. With recent judicial decisions affirming an individual's right to keep and bear arms under the Constitution, in particular for purposes of self-defense, firearm ownership is likely to remain widespread. By some estimates, over 355 million guns are currently owned in the country, with 70 million being handguns. Across 70,000 licensed dealers nationwide, there are estimated to be over 2 million new handgun sales yearly.

As with any tool with destructive capabilities, there is a potential for abuse and misuse. Because of its lethality, the harm resulting from inappropriate uses of firearms are compounded or exacerbated. While the number of improper uses is greatly outnumbered by legitimate incidents, improvements with respect to safety are continuously sought. Firearm safety is generally approached from multiple fronts that each attempts to meet a distinct objective, with some efforts being more effective in fighting perceived deficiencies than others.

Before purchase, Federal and State laws mandate criminal and mental health background checks to ensure that firearms do not fall into the hands of otherwise prohibited individuals. Advancements in computer and database technology have made instant background checks possible, though some jurisdictions nevertheless impose waiting periods, ostensibly for the purposes of allocating extra time to conduct further background checks and for the purchaser to "cool off" instead of committing a crime of passion. Along the same lines as these restrictions, there are various safe storage and child safety lock laws that requires adults to safeguard firearms from access and accidental discharge by children.

Additionally, certain classes of firearms and those having certain characteristics have been banned or are heavily regulated. For example, restrictions on weapons capable of fully automatic fire have long existed, and there have been renewed calls for banning so-called semiautomatic "assault weapons" based on alleged military features such as pistol grips, flash suppressors, and the like. Still further, manufacturers are prohibited from selling handguns in some jurisdictions without meeting safety requirements such as loaded chamber indicators, magazine disconnects, passing drop tests.

Possibly the most important effort to improve firearm safety, though often overlooked, is raising individual competency levels in weapon manipulation, marksmanship and threat assessment. Safety is contingent on each firearm owner's adherence to the principles thereof, and depends on proper education. Many training opportunities are offered for a wide range of skill levels, and are relatively well attended.

Despite these wide-ranging measures, many may still be apprehensive of firearm ownership, both personally and by others. For instance, spouses or other family members may feel uncomfortable with keeping a loaded firearm in the home, no matter how remote the possibility of accidental shootings under proper storage conditions. Indeed, there have been incidents of a child somehow gaining access to a firearm and accidentally discharging it, resulting in injuries to bystanders. Furthermore, there are also worries that a firearm carried on the person may get used by a perpetrator against the actual owner after being inadvertently let go during a physical altercation. Due to these concerns, ordinary law-abiding citizens may forego purchasing a firearm, and even when able to do so under local laws, not carry it while going about their daily lives.

The possibility of a firearm being forcibly taken from a legitimate or authorized user by a dangerous criminal is a concern even for professionals such security personnel, law enforcement officers, and correction officers. Although legislated a "gun free zone," educational institutions may be vulnerable to mass shooting attacks, necessitating armed guards. However, some parents may oppose this, citing the inherent dangers of firearms and the risk of it being taken from the guard to be used against students. Police officers are often required to use multi-level retention holsters that require the skillful manipulation of buttons and latches to release, and involve fine motor functions that may be difficult to perform under stress without substantial training. These additional retention mechanisms are necessary because officers typically come into close physical contact while making arrests, and holstered weapons are often within an arm's reach of detainees. Indeed, there are numerous reported incidents where the law enforcement officer is shot with his or her own firearm. Correction officers are prohibited from carrying firearms into the detention facility, and must rely on less lethal weapons such as electronic stun guns and pepper spray in case prisoners overtake the officers.

Any safety or locking system incorporated into a firearm must be readily accessible when needed, while otherwise rendering it safe and inert. These objectives are seemingly exclusive of each other: safeties that can be readily disengaged tend to render the firearm unsafe overall for that very reason, while safeties and locks that robustly secure the firearm tend to be cumbersome and time-consuming to disengage. Conventional designs are inevitably a compromise that emphasizes accessibility over safety, or vice-versa.

Even those firearms that are relied upon for defensive purposes are commonly stored in safes. Depending upon the unlocking mechanism, it can take up to half a minute or more to open. Although keyed locks are quick to open, in order to ensure that no unauthorized individuals access its contents, the keys must be kept secure, thereby increasing the likelihood of loss or damage. Combination locks do not require keys, but the entry of the combination via numeric keypads and dials can take a significant amount of time.

In addition to storing the firearm in a secure safe, there are additional measures that may be taken to decrease the likelihood of negligent discharges. These include separately locking the action with a cable lock device, keeping the firearm unloaded, with ammunition and ammunition feeding devices stored separately, removing and separately storing certain essential components of the firearm, and so forth.

All of these measures, including storage in a safe, unfortunately increase the length of time between detecting a threat and firing in self defense. Considering the speed with which various crimes are carried out, the targeted victim is in a position of substantial disadvantage, particularly where the perpetrator has the advantage of the element of surprise.

Accordingly, there is a need in the art for a firearm locking system that does not compromise between safety and accessibility, and enables and encourages responsible ownership. There is also a need in the art for a safety system that locks and prevents the operation of a firearm without valid biometric credentials, as well as a firearm lock that prevents the disengagement of existing safeties, among others.

BRIEF SUMMARY

In accordance with various embodiments of the present disclosure, a lock for a firearm with a grip safety, and a sear engageable to a biased hammer in a cocked position and releasable by a trigger is contemplated. The lock may include a housing defining a first bore within which a mainspring that biases the hammer is received. The housing may also define a second bore. Additionally, there may be a locking pin retractable into and extendible out of the second bore of the housing. When the locking pin is in an extended position, the grip safety is restricted to an engaged state, blocking movement of the trigger. There may also be an actuator disposed in the housing and cooperatively linked to the locking pin. The actuator may provide the motive force for retracting and extending the locking pin.

According to another embodiment, a firearm is disclosed. The firearm includes a frame, as well as a hammer that may be pivotally mounted thereto and defining at least one sear engagement surface corresponding to a cocked position. The hammer may also define a firing pin striking surface. There may also be a hammer strut linked to the hammer. Furthermore, the firearm may include a sear pivotally mounted to the frame and defining a hammer engagement surface frictionally engaged to the sear engagement surface of the hammer. There may also be a disconnector that is selectively engageable to the sear. The firearm may further include a trigger with a trigger bar in frictional engagement with the disconnector. There may be a mainspring housing assembly attached to the frame and defining a first bore receptive to a mainspring and a mainspring cap. The hammer strut may be retained in the mainspring cap in compression against the biasing of the mainspring. The hammer in the cocked position may be resultantly biased against the sear, with movement of the trigger bar against the sear releasing the hammer from the sear. The firearm may further include a safety latch having a set position that blocks movement of the sear, as well as a grip safety with a trigger stop. In released position, the safety latch blocks movement of the trigger bar and in a depressed position, allows movement of the trigger bar. There may be a secondary lock including a locking pin having a first position extending from the mainspring housing and a second position retracted within the mainspring housing. The pin blocks movement of the grip safety in the first position and permits movement of the grip safety in the second position.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The present disclosure relates to the concurrently filed co-pending application entitled "FIREARM LOCKING SYSTEM," the disclosure of which is expressly incorporated by reference in its entirety herein. In general, the various embodiments disclosed herein contemplate locks and locking systems for firearms, as well as firearms utilizing the same. The firearm remains locked at all times but immediately unlocking when an authorized user holds the firearm normally without the necessity of additional devices or actions to perform before firing. The locks and locking systems are intended for seamless integration with existing firearms without permanent modifications thereto, though readily incorporated into new designs.

The detailed description set forth below in connection with the appended drawings is intended as a description of the presently contemplated embodiments of the firearm locks and locking systems, and is not intended to represent the only form in which the disclosed invention may be developed or utilized. The description sets forth the various functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second, top and bottom and the like are used solely to distinguish one from another entity without necessarily requiring or implying any actual such relationship or order between such entities.

Figure 1:
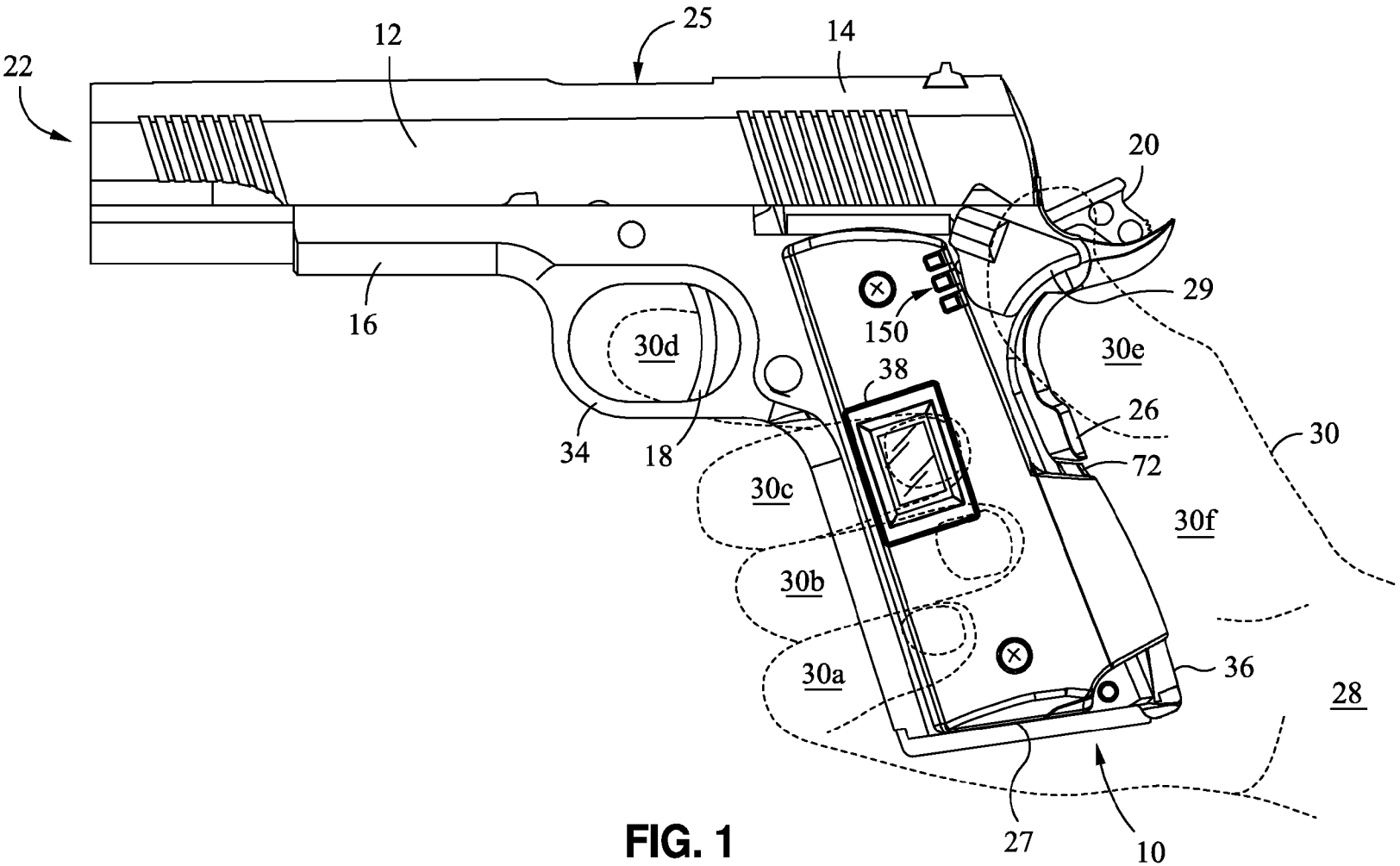
FIG. 1 is a left side view of a firearm including a locking system in accordance with one embodiment of the present disclosure held in a hand of a user.

With reference to FIG. 1, there is shown one exemplary firearm locking system 10 incorporated into a firearm 12. By way of example only, the firearm 12 is a self-loading semi-automatic pistol of the type disclosed in U.S. Pat. No. 984,519 by J. M. Browning, commonly referred to as the M1911/M1911A1 style, or simply the "1911." The operational principles of the 1911 pistol are well known in the art, and only the details thereof pertaining to the functionality of the locking system 10 will be described. While the several embodiments of the firearm locking system 10 are described in relation to the 1911-style pistol, those having ordinary skill in the art will recognize that it may be incorporated into other firearms, including pistols of different designs, revolvers, rifles, shotguns, and so forth.

Generally, the firearm 12 is comprised of a breech slide 14 that reciprocates along a frame 16 to locks an ammunition cartridge into a chamber of a barrel (not shown) before discharging, extracting the spent casing from the chamber upon firing, and ejecting the same to cycle a new cartridge. Based upon an actuation of a trigger 18, a hammer 20 is released to strike a firing pin (not shown) in the breech slide 14. The firing pin detonates an explosive primer of the ammunition cartridge and ignites the smokeless power contained therein, with the force of the resulting expanding gasses expelling the bullet from a muzzle end 22. The 1911 pistol relies upon force of recoil to cycle the breech slide 14 rearward after firing. During this movement an extractor (not shown) disposed in the breech slide 14 captures the spent casing and together moves rearward until hitting an ejector (not shown) mounted to the stationary frame 16. The force against the ejector pushes the casing outwards from an ejection port 25 defined by the breech slide 14. The 1911 pistol incorporates two external safeties including a thumb safety 24, and a grip safety 26, the engagement of either of which prevents the discharge of the firearm 12.

The firearm 12 is depicted as held by its grip 27 by a user 28, specifically in a right hand 30 thereof. Specifically, a little finger 30*a*, a ring finger 30*b*, and a middle finger 30*c* grasp the grip 27 and wrapped around a front strap 32 thereof. An index finger 30*d* is positioned near a trigger guard 34, for pressing the trigger 18. A thumb 30*e* and a portion of the palm 30*f* wraps around a rear strap 36, and the thumb 30*e* is positioned to engage and disengage the thumb safety 24.

As briefly mentioned above, various embodiments of the present disclosure contemplate the firearm 12 remaining locked at all times but unlocking when the user 28 is validated. The validation procedure involves the hand 30 being placed on the grip 27 in a normal firing position. This functionality is understood to be provided by the locking system 10. With additional reference to the block diagram of FIG. 2, the locking system 10 includes an imaging array sensor 38 that is attachable to the grip 27. The imaging array sensor 38 is receptive to biometric input that corresponds to a physiological feature of the user 28, with the most conveniently accessible one from a typical firing position being the middle finger 30*c*. The middle finger 30*c*, as do the other fingers, has a fingerprint pattern. Fingerprints are widely recognized as identifying a person uniquely, and are utilized by the locking system 10 therefor. Depending on the fit of the grip 27 to the hand 30 of the user 28, other digits besides the middle finger 30*c* may be positioned over the imaging array sensor 38. As such, the locking system 10 may be configured for any other finger. It will be recognized that while reference will be made to the imaging array sensor 38, it need not be limited to an array; a less sophisticated single row sensor may also be used. Whereas an array sensor permits the fingerprint pattern to be read by merely placing the finger thereon, it may be necessary for the finger to be swiped in the case of a single row sensor. The biometric input need not be limited to fingerprints, however, and other physiological features that are capable of uniquely identifying individuals may be substituted. Other physiological features include irises, palms, voice, face, and so forth, and those having ordinary skill in the art will recognize the corresponding sensor devices that are necessary for reading the same. The imaging array sensor 38 may thus be referenced more generally as a biometric sensor or an authentication input device. Indeed, one contemplated simple authentication input device may be a series of buttons that are pressed in sequence to enter a code known only to specific individuals.

Figure 3:
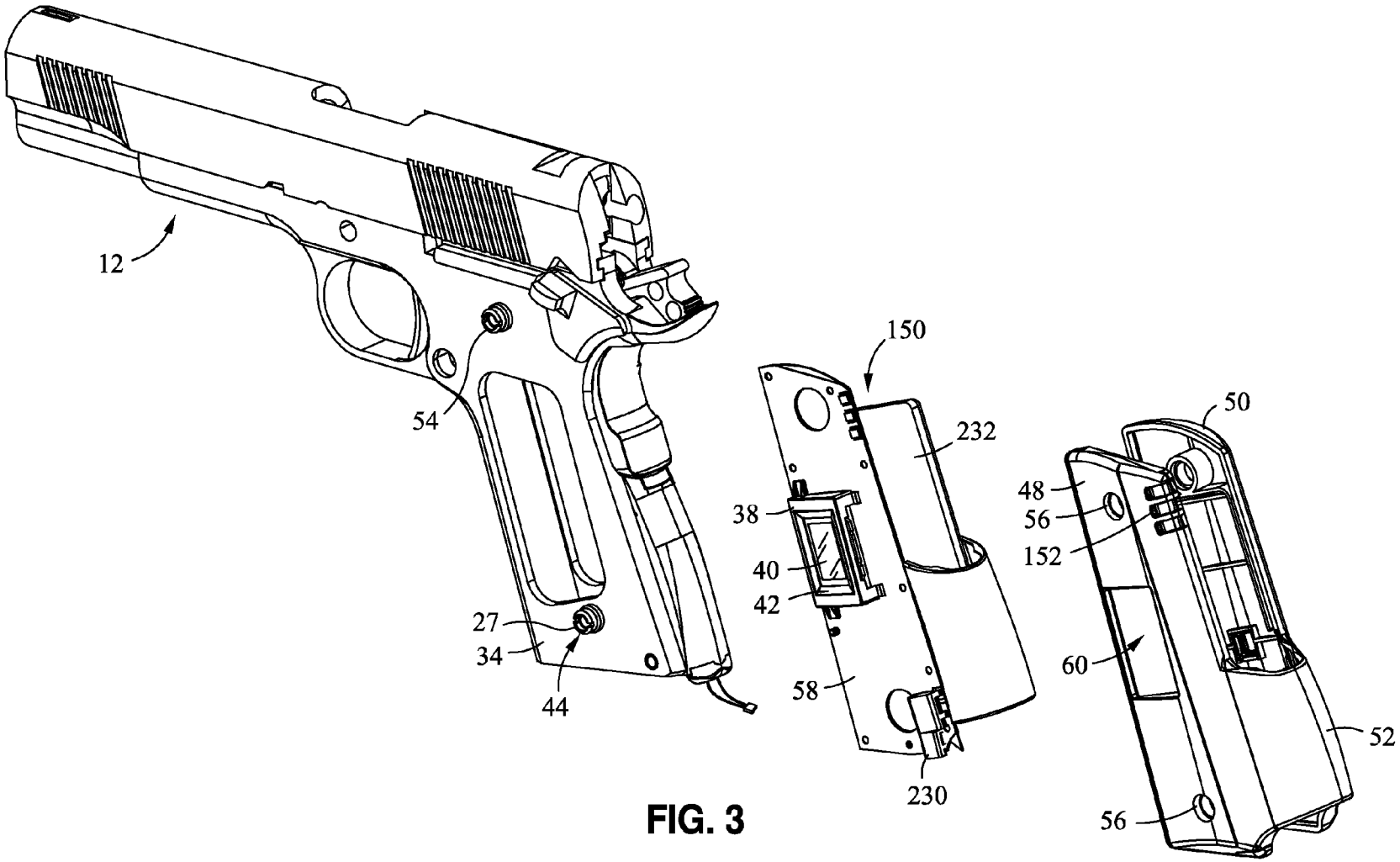
FIG. 3 is an exploded left side perspective view of the firearm and the locking system.

There are several different imaging array sensors that can be utilized for capturing the fingerprint of the user 28. In accordance with one embodiment, the imaging array sensor is the TCS2 TouchChip sensor available from AuthenTec, Inc. of Melbourne, Fla. The imaging array sensor 38 is of the active capacitance type, in which a voltage is first applied to a surface 40 thereof. There is an electric field that is generated between the finger and the sensor that follows the ridge patterns in the skin. After discharge, the voltage across the skin and the sensor is compared against a reference voltage to determine the capacitance values at each sensor element. The relative heights of the ridges are calculated, with a data set of prominent features being generated therefrom. In some embodiments, it is possible to generate an image of the entirety of the fingerprint, rather than selected parts of the prominent features. As shown in FIG. 3, the surface 40 is surrounded by a bezel 42 to assist in guiding placement of the finger and for electrostatic discharge purposes. Besides capacitive sensors, other types of sensing modalities may be used, such as frustrated internal reflection, thermal, inductive, and others. The specific active capacitance type of the imaging array sensor 38 is presented by way of example only and not of limitation.

Figure 4:
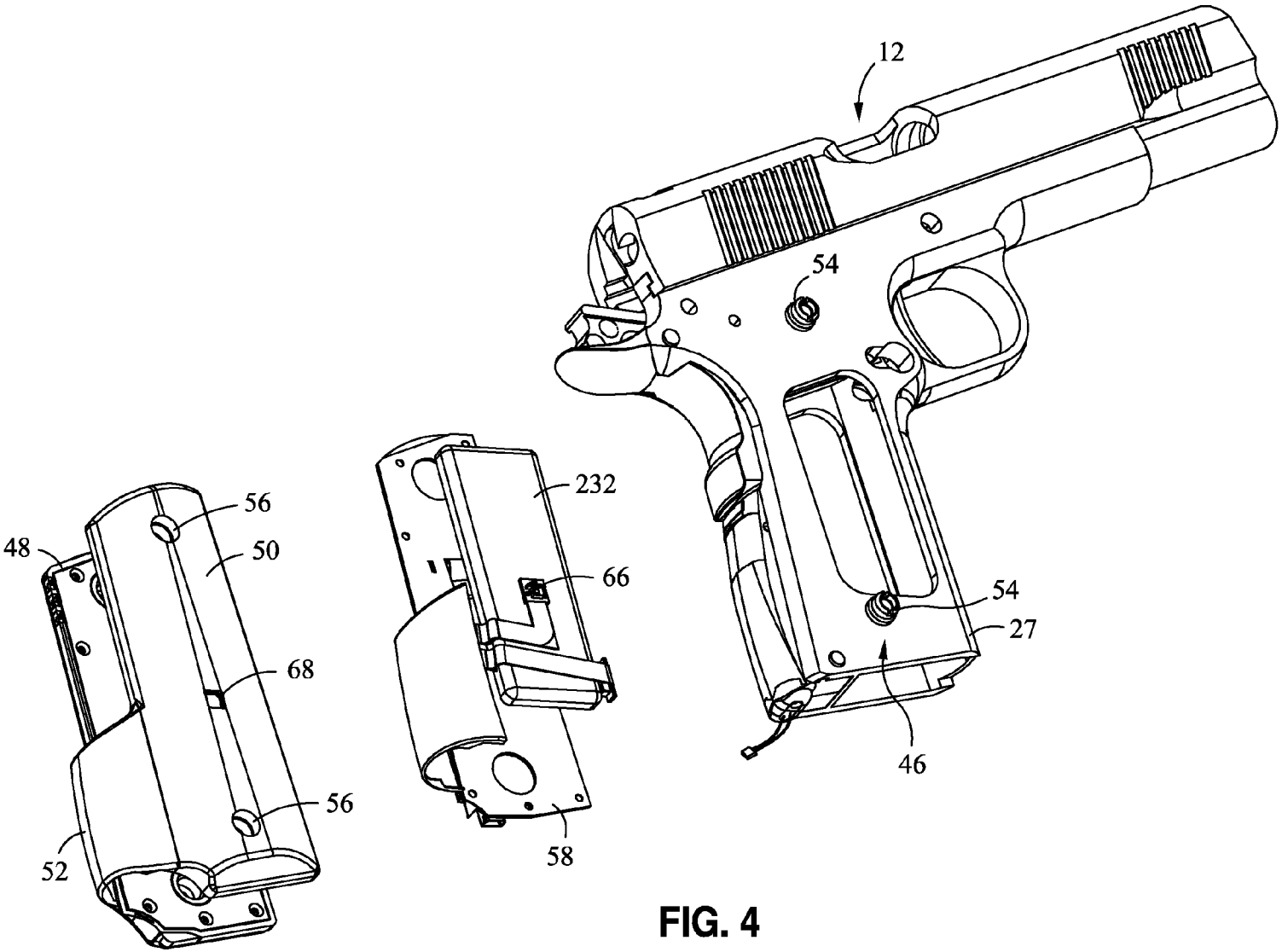
FIG. 4 is an exploded right side perspective view of the firearm and the locking system.

Referring to FIG. 3 and FIG. 4, the grip 27 of the 1911 pistol is defined by a left side 44 and an opposed right side 46. In this regard, there is a corresponding left grip panel 48 secured to the left side 44, and a right grip panel 50. In some embodiments, there is an optional connecting bridge 52 that links the left grip panel 48 to the right grip panel 50 over a portion of the rear strap 36 when installed on the grip 27. Both sides of the grip 27 each include a pair of grip bushings 54 to which screws thread on to in order to secure the grip panels 48, 50 to the grip 27. The grip panel 48, 50, thus define grip screw holes 56 that are coaxial with the grip bushings 54. Those having ordinary skill in the art will recognize that the size and shape of the grip panels 48, 50 and the positioning of the grip screw holes 56 are substantially the same as the original equipment versions, thus allowing ready replacement.

Sandwiched between the left grip panel 48 and the left side 44 of the grip 27 is a circuit board 58, upon which the imaging array sensor 38 is mounted. With the circuit board 58 disposed underneath the left grip panel 48, the imaging array sensor 38 remains exposed through a sensor opening 60 defined by the left grip panel 48, and the angular placement of the imaging array sensor 38 is such that there is general conformance to the external contour of the same. Along these lines, it is further contemplated that the positioning of the imaging array sensor 38 is optimized for fitting a wide range of users, such that the positioning and entry of the biometric input is instinctive impossible without additional training. The imaging array sensor 38 is disposed on the left side 44 of the grip 27 to accommodate right-handed users 28, who place the middle finger 30*c* in a normal strong-hand shooting position. An alternative configuration of left-handed users contemplates mounting the imaging array sensor 38, and hence the circuit board 58 and other components thereon, on the right side 36 of the grip 27.

The imaging array sensor 38 is connected to and in communication with a biometric input controller 62, which processes the input biometric feature data sets generated by the imaging array sensor 38 in various ways and generates outputs in response thereto. According to one embodiment, the aforementioned TCS2 TouchChip component includes the biometric input controller 62 and is thus part of the same package. The biometric input controller 62 includes a memory 64 in which biometric feature data sets corresponding to enrolled user identities are stored. In other embodiments, however, the memory 64 may be independent of and separate from the biometric input controller 62. Along these lines, there may be additional external memory modules that expand the capacity of the biometric input controller 62. There may be up to twenty separate identities and corresponding biometric feature data sets stored in the memory 64.

One of the processing operations may include a comparison of the most recently received biometric feature data sets to those stored in the memory 64 and identifying a correspondence to an existing identity. The results of such a comparison and identification operation may be generated as an output by the biometric input controller 62. In one embodiment, this output is referred to as a biometric input validation status indicator signal. There are several known fingerprint analysis algorithms that are known in the art, and any algorithm capable of completing the task within set time constraints based upon the data processing capabilities of the integrated discrete-time signal processor (DSP) may be utilized.

Figure 2:
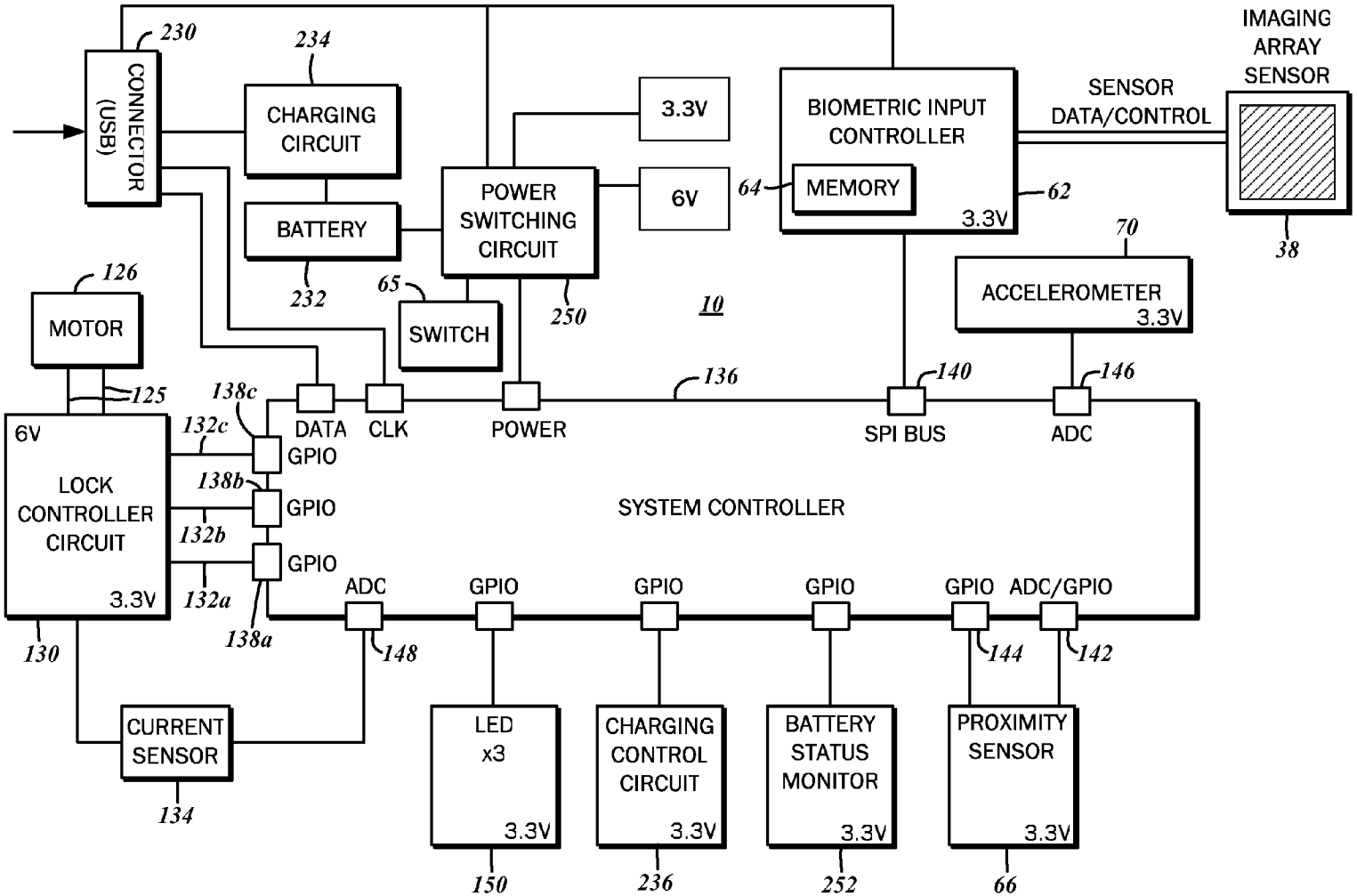
FIG. 2 is a block diagram of the firearm locking system including its constituent components.

For power conservation purposes, the circuitry of the firearm locking system 10 remains switched off until use. As shown in FIG. 2, there is a switch 65 that is mechanically coupled to the bezel 42, which is hinged in relation to the grip 27. The switch 65 is understood to be of a dome type that has an open state and a closed state, and capable of being locked to those positions when there is no force against the bezel 52. However, alternative switch modalities may be readily substituted to implement different user interface experiences, for example, a momentary pushbutton, and the like. The switch 65 is understood to wake the biometric input controller 62, which can activate the imaging function of the imaging array sensor 38. As will be discussed in further detail below, the switch 65 is connected to a power switching circuit 250, which delivers power to the various electronic components of the locking system 10. The switch 65 may thus be a master power switch.

With the imaging array sensor 38 being a capacitive type, merely bringing the finger in close proximity thereto is operative to generate a signal that can be conveyed to the biometric input controller 62 without the entirety of the circuit being powered. Thus, the locking system 10 can be maintained in a semi-sleep state without draining excessive power. The initial signal detecting the presence of the finger can wake the biometric input controller 62, which can then activate the imaging function of the imaging array sensor 38 to capture the biometric feature data set. Once captured, the data can be transferred to the biometric input controller 62. From initialization to image capture, an elapsed time period of less than half a second is contemplated.

Referring again to the block diagram of FIG. 2, the locking system 10 also includes a proximity sensor 66 that detects possession of the firearm 12 by the user 28. The proximity sensor 66 generates a grip detection indicator signal that corresponds to the presence or absence of an obstruction upon it. The grip detection indicator signal may be a simple digital high or low output by a detector circuit connected to an infrared photodiode, which senses a counterpart signal generated by an infrared light emitting diode. When a reflection of the infrared signal is detected, it corresponds to an obstruction being present. In addition to a simple present-not present input, the proximity sensor 66 is capable of generating a continuously varying voltage value that corresponds to the amount of detected reflection of the infrared signal. Thus, shades of light/dark, as well as distance can be detected. This feature is understood to make detection of various states more accurate and reliable. For example, it may be possible to detect the shade of skin of the user 28 and differentiate between that of an authorized user and that of an unauthorized user, and perform locking operations accordingly. Notwithstanding the reference to the grip detection indicator signal, it is understood that such signal need not be limited to indicating the grip of the user 28. The presence or absence of any obstruction as read by the proximity sensor 66, such as when the firearm 12 clears or re-enters a retention device may also be indicated. It will be appreciated that there are other types and configurations of proximity detectors, and any such alternatives may be readily substituted without departing from the present disclosure.

As shown in FIG. 4, the proximity sensor 66 is disposed on the right side 46 of the grip 27. During typical use with the right hand 30 maintaining a hold on the grip 27, it is understood that there are only limited circumstances in which the proximity sensor 66 would not be activated indicating that the hand 30 is placed against it. In general, these circumstances correspond to the firearm 12 having been dispossessed. So that the proximity sensor 66 has an unobstructed vision of the exterior of the right grip panel 50, there is a sensor aperture 68 coaxial with the mounting of the proximity sensor 66. Again, the configuration of the proximity sensor 66 being on the right side 46 of the grip 27 is suitable for right-handed users 30. For those left-handed, the proximity sensor 66 is mounted to the left side 44 and against the left grip panel 48. Though only one configuration of the position of the proximity sensor 66 is shown, it is understood that any other suitable configuration may be used, and may be dependent on the comfort needs of the user, the ergonomics of the underling firearm 12, and so forth.

The locking system 10 further includes an accelerometer 70 that may be mounted in a predetermined orientation to the firearm 12. Specifically, the accelerometer may be mounted to the circuit board 58 and electrically connected to the other components thereon. The accelerometer 70 senses the specific forces (g-forces) including on the firearm, and generates a corresponding specific force indicator signal. According to one embodiment, the accelerometer 70 is the MMA7341L 3-axis sensing accelerometer integrated circuit available from Freescale Semiconductor, Inc., of Austin, Tex. This device is understood to generate continuously, when activated, an analog output signal representative of the detected specific force. As will be described in more detail below, certain detected specific forces of the firearm 12 are understood to be associated with specific conditions, such as reloading, dropping, and so forth, and the locking system 10 can function accordingly. Depending on the sophistication level of motion and orientation detection involved, an accelerometer with more or less than three axes may be utilized.

Figures 5, 6A:
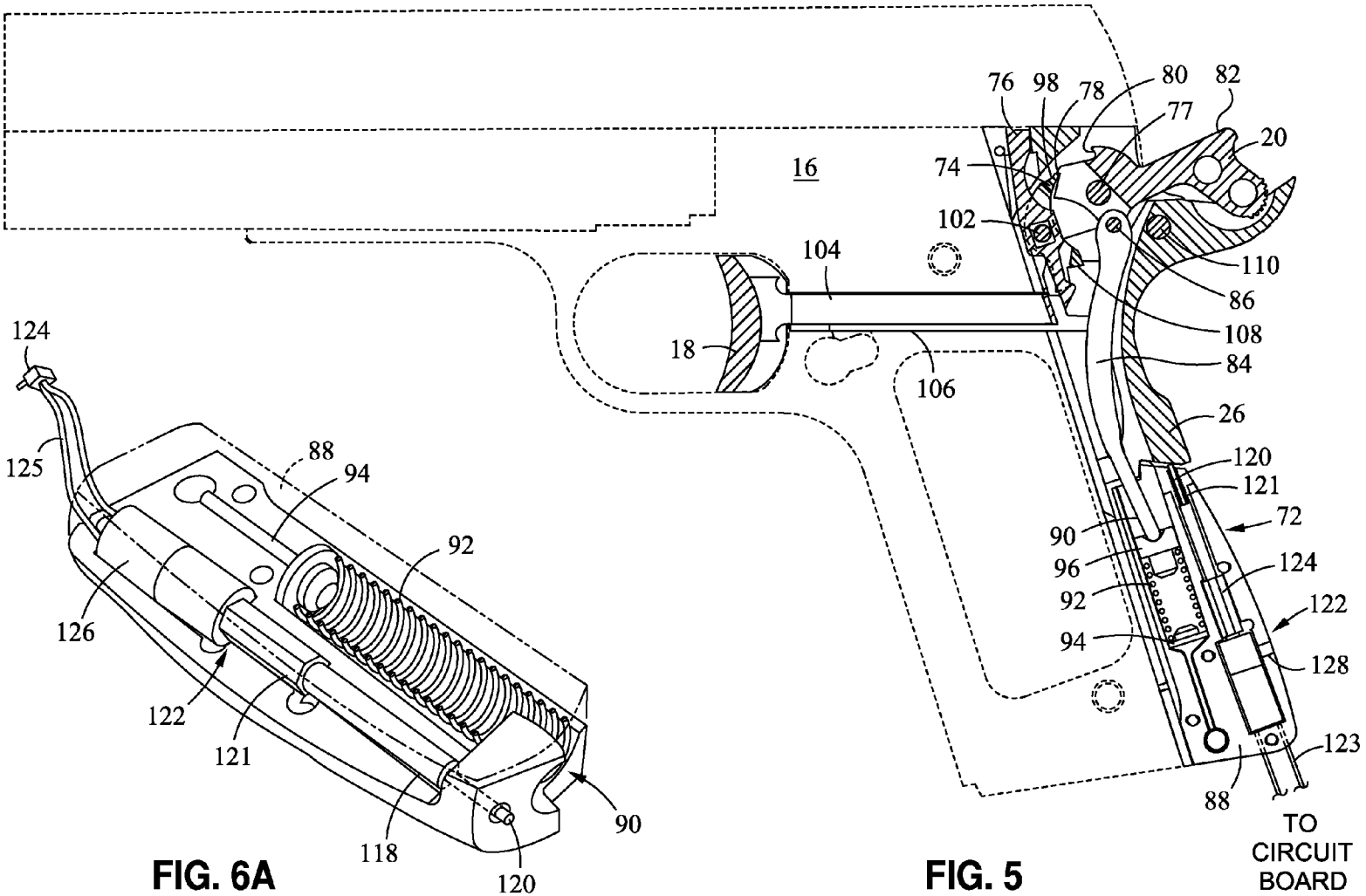
FIG. 5 is a left side cross-sectional view of the firearm illustrating a fire control group and a lock in accordance with one embodiment of the present disclosure.
FIG. 6A is a cut-away perspective view of a first embodiment of a modified mainspring housing utilized in the lock.

The firearm locking system 10 includes a lock 72 having a set state and an unset state. With the lock 72 in the set state, substantial movement of any one or more fire control group components of the firearm 12 are inhibited. FIG. 5 best illustrates the fire control group components of a typical 1911 handgun, which include the trigger 18, the hammer 20, the thumb safety 24, the grip safety 26, a sear 74, and a disconnector 76. More particularly, the hammer 20 is pivotally mounted to the frame 16 with a hammer axis pin 77, which defines a full cock sear engagement surface 78, a half cock sear engagement surface 80, and a firing pin striking surface 82. The hammer 20 is pivotally linked to a hammer strut 84 with a hammer strut pin 86. The hammer strut 84 extends downwards along the grip safety 26 and to a mainspring housing 88.

The mainspring housing 88 defines a first bore 90 within which a coiled mainspring 92 is received, along with a mainspring housing pin retainer 94 disposed in the bottom portion thereof and a mainspring cap disposed in the top portion thereof. The mainspring cap 96 reciprocates upwards and downwards along the central axis of the first bore 90, and is in engagement with the hammer strut 84. Specifically, the mainspring cap 96 defines a recess within which the tip of the hammer strut 84 is received in a movable relationship. With the force of the mainspring 92, the mainspring cap 96 is biased upwards, and is compressed against the hammer strut 84. This translates to a counterclockwise (from the perspective shown in FIG. 5) rotational bias upon the hammer 20, which upon release from the sear 74, causes the same to rotate in a counterclockwise (from the perspective shown in FIG. 5) direction. The mainspring housing 88 is mounted to the frame 16 via a mainspring housing pin 100, set in place with the mainspring housing pin retainer 94.

The sear 74 defines a hammer engagement surface 98 upon which the hammer 20, and specifically the full cock sear engagement surface 78 thereof, is pressed. The sear 74 is pivotally mounted to the frame 16 with a sear pin 102, which also holds the disconnector 76 in selective engagement with the sear 74. In further detail, the trigger 18 includes a trigger bar 104 that reciprocates in a backward-forward direction along a trigger bar channel 106 defined by the frame 16. The disconnector 76 has a raised position in which it contacts the sear 74, as well as a lowered position in which it does not. The trigger bar 104 is in substantial contact with the disconnector 76, and when the trigger 18 is pressed, the disconnector 76 and the sear 74 is rotated in a counterclockwise (from the perspective shown in FIG. 5) direction. This releases the hammer 20 from the sear 74, and the sear 74 from the disconnector 76. While not depicted, there is a leaf spring that biases the sear 74 and the disconnector 76, as well as the trigger bar 104 to the ready positions.

As mentioned above, the 1911 type pistol includes the thumb safety 24 that includes a sear stop 108. The thumb safety 24 also includes an integral axis pin 110 for pivotally mounting to the frame 16. The axis pin 110 further pivotally mounts the grip safety 26 to the frame 16. When engaged or in a set position, the sear stop 108 blocks movement of the sear 74.

Figure 7:
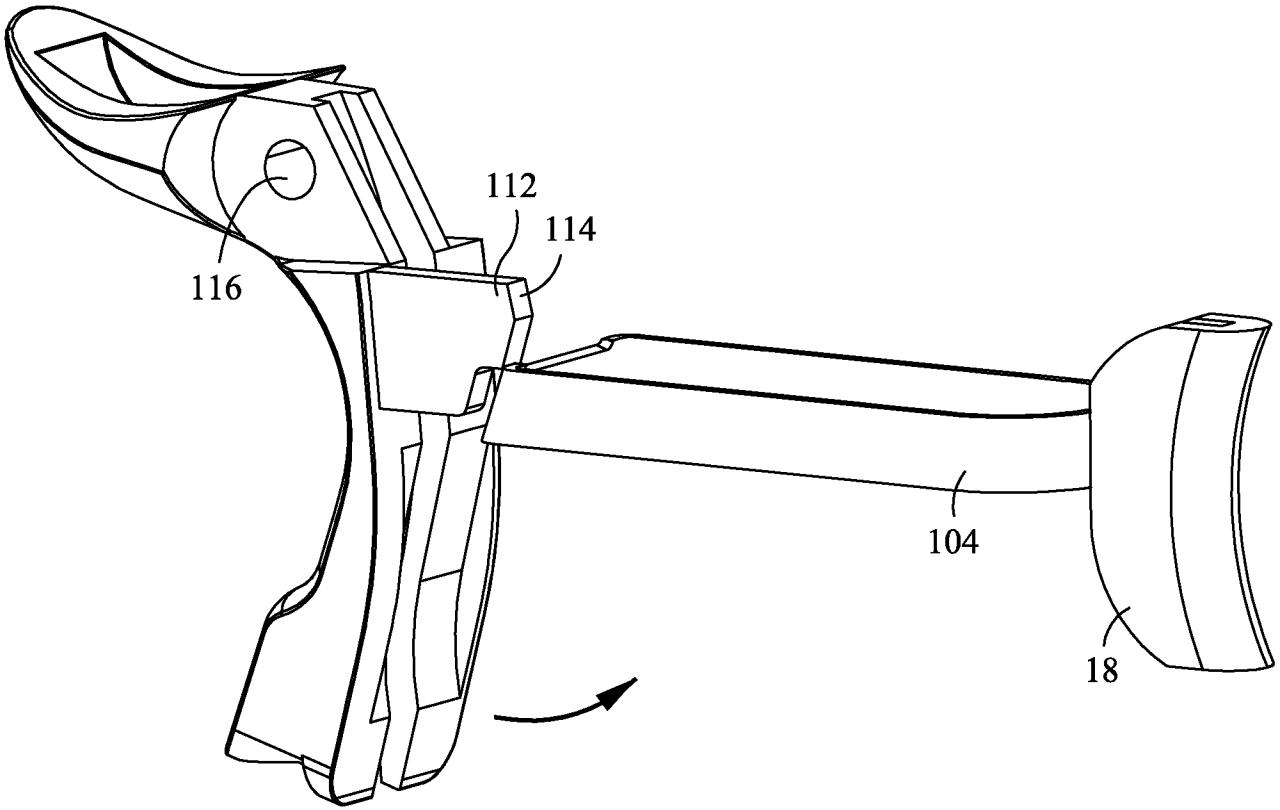
FIG. 7 is a perspective view of a trigger and a grip safety.

Referring to FIG. 7, the way in which the grip safety 26 cooperatively functions with the trigger 18 and the trigger bar 104 will now be described. The grip safety 26 includes a trigger stop tab 112 that, when in a released position, blocks the rearward movement of the trigger 18 and the trigger bar 104. Specifically, a stop surface 114 contacts the trigger bar 104 in opposition. When the grip safety 26 is depressed, it rotates in a counterclockwise direction (from the perspective shown in FIG. 7) about a thumb safety axis hole 116. This raises the trigger stop tab 112 and hence the stop surface 114 away from the movement path of the trigger bar 104, allowing force against the disconnector 76 as mentioned above. The leaf spring, briefly noted above, includes a separate element that biases the grip safety 26 in a clockwise direction (from the perspective shown in FIG. 7).

Although details of the fire control group for a specific 1911 pistol have been described, many variations exist. One embodiment of the lock 72 is configured to cooperate with such a particular fire control group, and those having ordinary skill in the art will be able to readily make adjustment to cooperate with alternative fire control groups, including those firearms that are not 1911 type pistols.

As mentioned above, the lock 72 prevents the substantial movement of any one or more fire control group components of the firearm 12 when set. In the embodiment shown in FIG. 5, the lock 72 is contemplated to block the movement of the grip safety 26, such that the trigger 18 is unable to be depressed. It is understood that other fire control group components are unaffected, in that the thumb safety 24 remains disengageable, the breech slide 14 is unobstructed, thus allowing a round to be chambered even though it cannot be fired, and the hammer 20 can be moved to a cocked position. Thus, the firearm 12 can be kept at condition one, that is, a chambered round, a cocked hammer 20, an engaged thumb safety 24, and an engaged grip safety 26. With other firearm configurations, any one of the corresponding fire control group components thereof may be prevented from substantial movement. For example, in a striker-fired weapon such as the Glock® pistol, the striker, the connector, or other such specific components are understood to be fire control group components, which can be locked with the lock 72. In revolver type weapons, a safety plate, as well as the hammer and the trigger, are understood to be fire control group components that can likewise be locked with the lock 72. Again, any otherwise selectively movable component in the firearm 12 is understood to be encompassed within the term fire control group.

Referring to FIG. 5 and FIG. 6A, a first embodiment of the mainspring housing 88*a* further defines a second bore 118. The lock 72 includes a locking pin 120 that is retractable into and extendible out of the second bore 118. In the extended position, the locking pin 120 blocks the rotation of the grip safety 26. On the other hand, in the retracted position, no obstruction is presented against the grip safety 26, allowing free movement thereof.

Within the second bore 118, there is disposed an actuator 122 that retracts and extends the locking pin 120. Any type of actuator may be utilized, though in one embodiment, it is electromechanical. In this regard, the actuator 122 may be comprised of a servo motor 126 with a planetary gear that translates rotational motion to linear motion. It will be recognized by those having ordinary skill in the art, however, that the actuator 122 may be a solenoid, a stepper motor, a bimetallic strip, a piezoelectric actuator, or any other suitable electromagnetic device. A telescoping shaft 121 couples the shaft of the servo motor 126 to the locking pin 120. The actuator 122 may be driven to a state in which the locking pin 120 is extended based upon a first electronic signal, and to a state in which the locking pin 120 is retracted based upon a second electronic signal. Accordingly, the actuator 122 may include one or more input wires 123 terminated by a connector 124 for receiving these electronic signals.

Figure 6B:
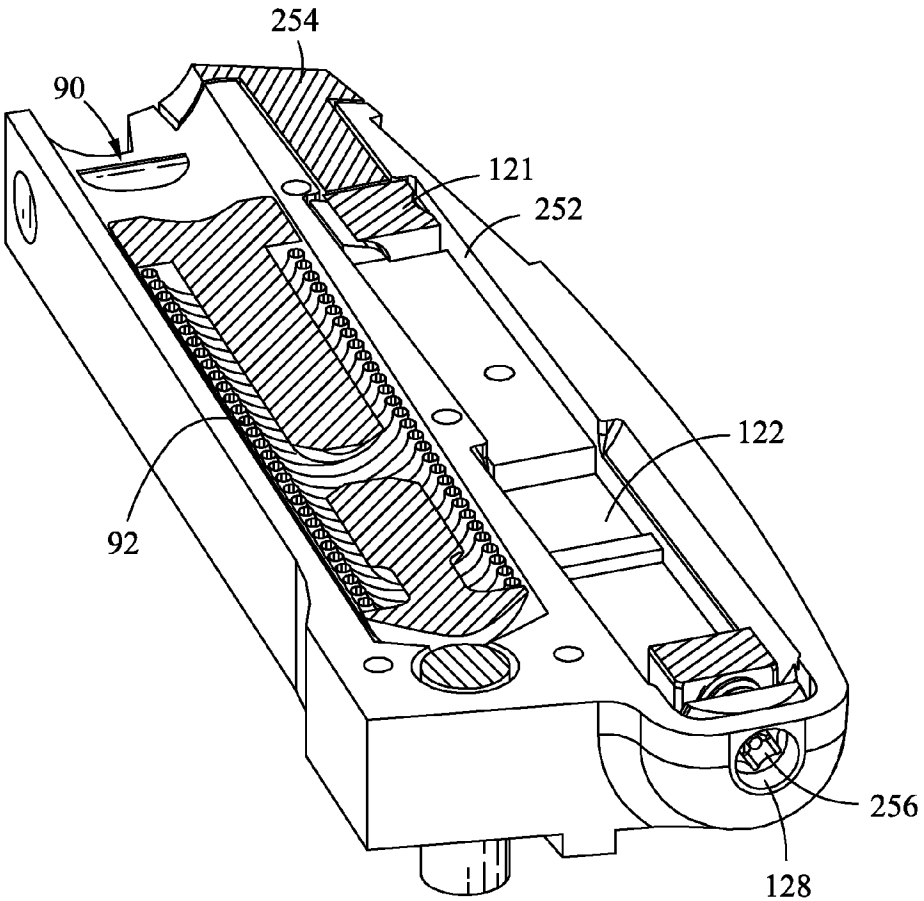
FIG. 6B is a cut-away perspective view of a second embodiment of the modified mainspring housing utilized in the lock.

FIG. 6B best illustrates a second embodiment of the mainspring housing 88*b*, which likewise defines a second bore 252 having an alternative configuration for accommodating various features detailed as follows. Disposed in the second bore 252 is the actuator 122 that includes the telescoping shaft 121. In the second embodiment, the movement of the grip safety 26 is selectively prevented with a blocking wedge 254, which has a retracted position and an extended position. The blocking wedge 254 is transitioned between these two positions with the actuator 122, to which it is coupled by way of the telescoping shaft 121. The shape and size of the blocking wedge 254 may be varied to accommodate varying configurations of the grip safety 26. As referenced herein, the blocking wedge 254 and the locking pin 120 have the same function of preventing the movement of the grip safety 26. In this regard, various features of the locking system 10 described herein in the context of the locking pin 120 are also applicable to the blocking wedge 254. While a shortened first bore 90 and mainspring 92 were utilized in the first embodiment of the mainspring housing 88*a*, the second embodiment 88*b* utilizes a conventional length mainspring disposed within the first bore 90.

In some cases, there may be a need to externally override the actuator 122, and so the second embodiment of the mainspring housing 88*b* defines an override key slot 128 through which a mechanical override 256 is accessed. According to one implementation, the mechanical override 256 includes a socket 258 that is mechanically linked to the actuator 122. By rotating the socket 258 with a key that is configured to be received therein, the telescoping shaft is retracted, thereby retracting the blocking wedge 254. Although one embodiment of the mechanical override 256 has been shown and discussed, those having ordinary skill in the art will recognize that other configurations are also possible.

Referring again to the block diagram of FIG. 2, first and second electronic signals that drive the actuator 122 is generated by a lock controller circuit 130. More particularly, the lock controller circuit 130 is a conventional H-bridge circuit, which bi-directionally connects a voltage source to a load, that is, the actuator 122, such that it can be driven in a forward direction and a reverse direction. Thus, the H-bridge circuit has two outputs connectable to the load, which correspond to the input wires 123 extending from the mainspring housing 88. The term first electronic signal may thus refer to a forward voltage, while the term second electronic signal may refer to a reverse voltage. The interconnection of the switches in the H-bridge circuit is achieved via a control signal on input lines 132*a-c*. The lock controller circuit 130 further includes a power amplifier circuit to isolate the high electrical current for the actuator 122 from the input lines 132.

The electrical current flowing through the H-bridge is monitored by a current sensor circuit 134, which may be utilized to determine when to stop the servo motor 126. As indicated above, the extension and retraction of the locking pin 120 or the blocking wedge 254 has mechanical limits, that is, the extent to which the locking pin 120 or the blocking wedge 254 can be extended or retracted is limited. When the servo motor 126 drives the locking pin 120 or the blocking wedge 254 to these limits, the shaft will not turn, but the current flow spikes. These spikes are detected by the current sensor circuit 134 and utilized to stop further power delivery. Thus, in any given extension cycle, the fit between the locking pin 120 or the blocking wedge 254 and the grip safety 26 can be tightened or maximized. Despite slight changes to the dimensions of various fire control group parts over time and use, and even with the introduction of grime and dirt, positive engagement to the grip safety 26 can be ensured.

The locking system 10 includes a system controller 136 that executes pre-programmed instructions with received inputs as parameters therefor, and generates outputs of the results of the processing. In various embodiments, the system controller 136 is an Intel 8051-based microcontroller integrated circuit, though any other data processing device may be utilized. The system controller 136 is understood to be mounted to the circuit board 58 and electrically connected to various components as described herein. A first set of outputs 138*a-b* are connected to the lock 72, and in particular, to the lock controller circuit 130 as discussed above. A first input 140 is connected to an output of the biometric input controller 62 to receive the biometric input validation status indicator signal. Since the output of biometric input controller 62 conforms to the Serial Peripheral Interface (SPI) connectivity standard, so does the first input 140. A second input 142 is connected to the aforementioned photodetector diode of the proximity sensor 66. Because the proximity sensor 66 depends on detecting a known optical signal, there is a corresponding light emitting diode, as discussed previously. The signal therefor is generated on a second output 144 of the system controller 136. A third input 146 is connected to the accelerometer 70 to receive the specific force indicator signal as generated as an analog voltage level thereby. Accordingly, the third input 146 is coupled to an analog to digital converter (ADC) that quantizes the voltage level to a discrete value. A fourth input 148 is similarly coupled to an ADC for converting the voltage generated by the current sensor circuit 134 to a discrete value.

The system controller 136 selectively actuates the lock 72 to the set state or the unset state based upon a received combination and sequence of the biometric input validation status indicator signal, the grip detection indicator signal, and/or the orientation indicator signal. At initialization, the lock 72 is in the set state to prevent actuation of the grip safety 26. As the user grips the firearm 12 in a natural hold, the user simultaneously places the finger upon the imaging array sensor 38.

The resultant input biometric image is received by the biometric input controller 62, which compares the same against the stored biometric images. If there is a match detected, the system controller 136 is signaled that there has been a match, by means of the biometric input validation status indicator signal. In response, the system controller 136 generates a signal on the first set of outputs 138*a-b*, which are transmitted to the lock controller circuit 130. The signal drives the actuator 122 to retract the locking pin 120, thereby placing the lock 72 in an unset state. In various embodiments, it is envisioned that from initial grip to unlock, less than one second elapses. Similarly, from a rejection of a biometric input to again accepting another attempt, less than one second elapses. While in one implementation, each lock/unlock cycle involves the triggering of the actuator 122, the lock 72 may be mechanically biased or spring-loaded. Upon retraction of the actuator 122 to the unset state, the locking pin 120 remains biased against the grip safety 26, such that a release of the grip safety 26 causes the locking pin 120 to be extended, placing the lock 72 to the set state, without further activation of the actuator 122.

At this point, the grip safety 26 is capable of being depressed, and so long as the thumb safety 24 is disengaged, pressing the trigger on 18 on a cocked hammer 20 will release it. The 72 remains in the unset state so long as the proximity sensor 66 generates the grip detection indicator signal, that is, the firearm 12 has not been dispossessed. In accordance with another embodiment, the lock 72 also remains in the unset state so long as the orientation indicator signal is representative of a normal operating condition of a firearm, e.g., not resting on either side on the ground and hence dispossessed, etc. This analysis may involve multiple readings of the accelerometer 70 over certain period of time, with specific types of changes being generally correlated to abnormal operating conditions. Those having ordinary skill in the art will be able to ascertain the various combinations and sequences of the grip detection indicator signal and/or the orientation indicator signal that establish these abnormal events, and readily implement the same in the system controller 136.

Upon detecting the abnormal condition based upon the input of the grip detection indicator signal and/or the orientation indicator signal, the system controller 136 again signals the lock controller circuit 130 to drive the actuator 122 in a forward direction, thereby extend the locking pin 120. Now, the locking pin 120 blocks movement of the grip safety 26, preventing the firearm 12 from being discharged. A change in the grip detection indicator signal or the orientation indicator signal does not necessarily require an instant change in the condition of the lock 72. More particularly, there may be a timer in the system controller 136 that counts down for a predetermined period of time, keeping the lock 72 unset during the count down. A subsequent return of the grip detection indicator signal or a normal reading of the orientation indicator signal within the count down can stop and reset the timer to prevent the lock 72 from being set. At the expiration of the count down, the lock 72 can be set. The time period is variable, and can be optimized for typical defensive scenarios.

In the above example, the system controller 136 is understood to be in a standard security mode, in which one successful reading of the input biometric image, that is, there is a confirmed match between the input biometric image and a biometric image for one of the enrolled user identities, is operative to unset the lock 72. According to various embodiments, certain predefined sequences of the biometric input transitions the system controller 136 into a different operating state than the standard security mode. After repeated failures to match the biometric input to an enrolled user identity, the system controller 136 can transition to a high security mode in which multiple successful readings are required before unsetting the lock 72. Upon successful unlocking in the high security mode, the system controller 136 can transition back to the standard security mode. Furthermore, as will be described in greater detail below, other sequences of the biometric input can transition the system controller 136 to an administrative mode for configuring multiple users.

Beyond the simple mechanical feedback received by the user 28 in the form of a disengageable grip safety 26, various embodiments of the present disclosure contemplate visual indicators to provide additional feedback. With reference to FIG. 1 and FIG. 3, the locking system 10 includes a set of three light emitting diodes (LEDs) 150. Each of the LEDs are understood to have multiple illumination colors, including red, green and yellow. The LEDs 150 are arranged in a single column and mounted to an upper right edge of the circuit board, corresponding to the upper right edge of the left grip panel 48. The left grip panel 48 defines cutouts 152 for exposing the LEDs 150 underneath. It will be recognized that the positioning of the LEDs 150 is by way of example only and not of limitation, and any other suitable location on the firearm 12 may be utilized. Furthermore, while an array of three LEDs 150 is shown, an array of more or less LEDs 150 can be substituted. As best illustrated in FIG. 2, the LEDs 150 are connected to the system controller 136 to visually indicate the various operating states thereof, as well as the success or failure of any identity matching and administration functions being performed. The output pattern of the LEDs 150 is understood to correspond thereto.

Figure 8:
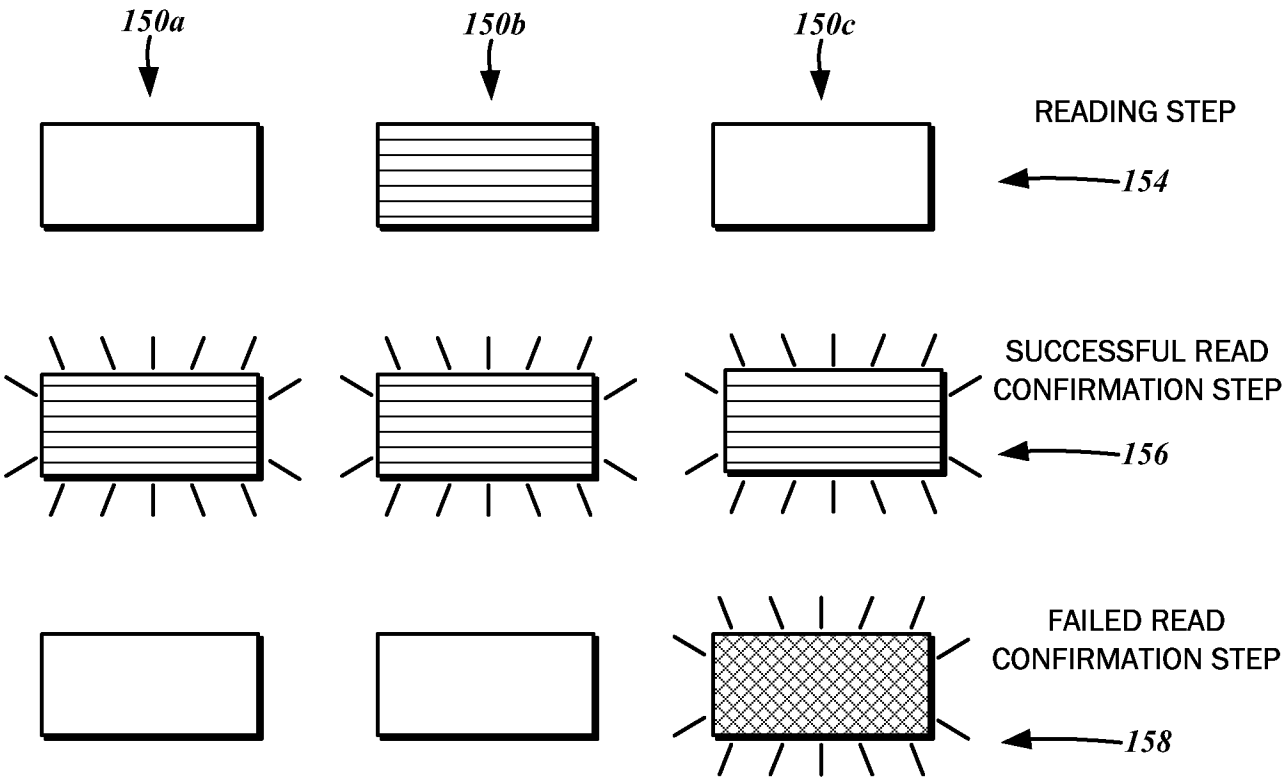
FIG. 8 shows the user interface in a sequence for unlocking the firearm for a user in a standard security mode.

The user 28 can interact with the system controller 136 via the imaging array sensor 38 based upon visual feedback presented on the above-described array of three LEDs 150. Specific examples of illumination patterns of such feedback will now be described, but it will be appreciated that many other patterns representing the same information are possible. Referring to FIG. 8, there is a first LED 150*a*, a second LED 150*b*, and a third LED 150*c*. In order to gain access to unlock the locking system 10, the user 28 places the finger on the imaging array sensor 38. During this time, per reading step 154, the second LED 150*b* is illuminated green. If a match to an existing identity is found, each of the first, second and third LEDs 150*a*-150*c* are illuminated green and flashed twice per successful read confirmation step 156. The lock 72 is then put in an unset state, allowing movement of the grip safety 26. Otherwise, the third LED 150*c* is illuminated red and flashed twice per failed read confirmation step 158, and keeps the lock 72 in the set state.

Figure 9:
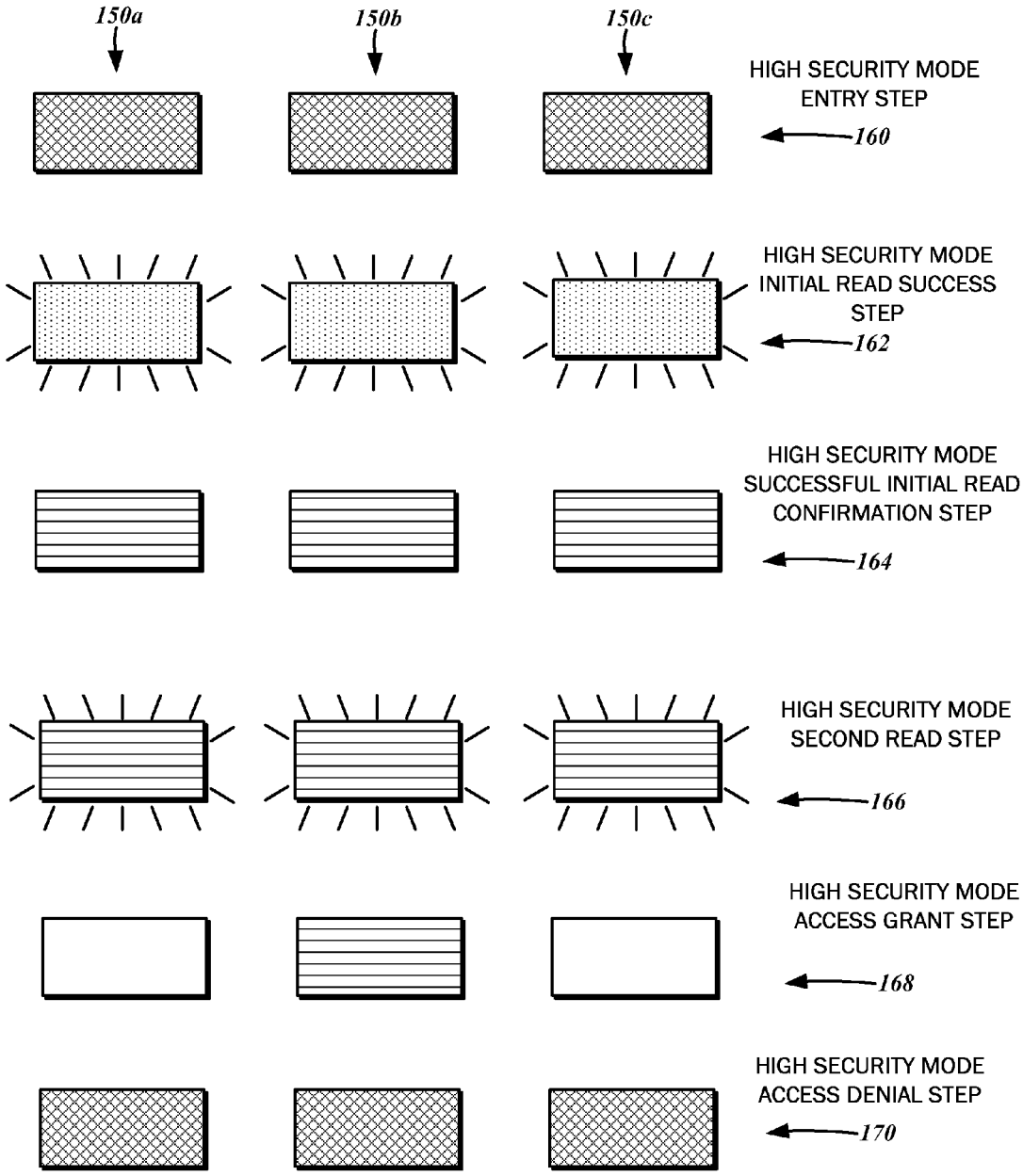
FIG. 9 shows the user interface in a sequence for unlocking the firearm for a user in a high security mode.

FIG. 9 illustrates the sequence for the high security mode. In the high security mode entry step 160, before the finger is placed on the imaging array sensor 38, each of the LEDs 150*a*-150*c* are illuminated red. Then, upon placing the finger on the imaging array sensor 38, each of the LEDs 150*a*-150*c* are illuminated yellow and flashed for a predetermined period of time in a high security mode initial read step 162. In accordance with one embodiment, this predetermined period is five seconds. Following this step, if a match to an existing identity is found, each of the LEDs 150*a*-150*c* are illuminated green in a high security mode successful initial read step 164 that continues after removing the finger from the imaging array sensor 38. The finger is again placed on the imaging array sensor 38, and upon a successful second read, each of the LEDs 150*a*-150*c* are illuminated green and flashed twice in a high security mode successful second read step 166. To indicate that the high security mode has been unlocked, the second LED 150*b* is illuminated green in a high security mode access grant step 168. If in either of the foregoing read steps fails, including the lack of any input following the high security mode initial read step 162, each of the LEDs 150*a*-150*c* are illuminated red in a high security mode access denial step 170. The system controller 136 remains in the high security mode.

Figure 10:
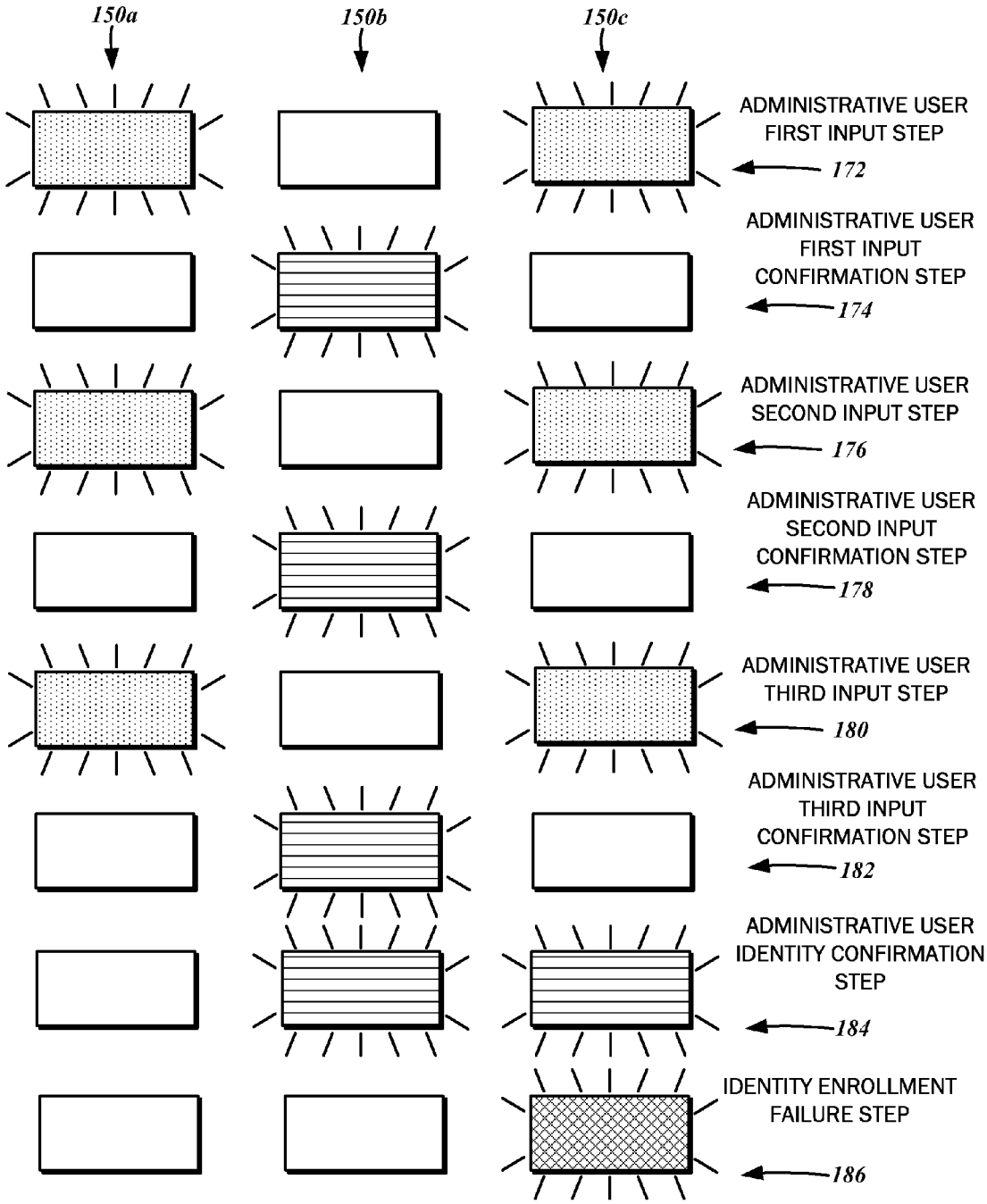
FIG. 10 shows an exemplary user interface for the locking system and a sequence involved for new unit registration.

When the locking system 10 is first activated, there are no user identities stored in the memory 64 of the biometric input controller 62. The present disclosure therefore contemplates various features for setting up the locking system 10 so that the normal unlocking and locking operations can proceed as described above. For various configuration purposes, there is understood to be administrative users and standard users. The administrative user is understood to have the capability to add and delete user identities, so this identity is configured at the initial startup. Referring to FIG. 10, in an administrative user first input step 172, the first LED 150*a* and the third LED 150*c* are illuminated yellow and flashing, waiting for the user to place the finger. While processing the input biometric image feature data set received thereby, the second LED 150*b* is illuminated green and flashed once to indicate success in an administrative user first input confirmation step 174. The first LED 150*a* and the third LED 150*c* are again illuminated yellow and flashing and waits for the user to release the finger and place again in an administrative user second input step 176. Likewise, while processing the input biometric feature data set, the second LED 150*b* is illuminated green and flashed once to indicate success in an administrative user second input confirmation step 178. This process is repeated a third time, and the first LED 150*a* and the third LED 150*c* are illuminated yellow and flashing while waiting for the user to release and re-place the finger in an administrative user third input step 180. Upon acceptance, the second LED 150*b* is illuminated green and flashed once to indicate success in an administrative user third input confirmation step 182. The administrative user identity is associated with the three received biometric feature data sets, and this is confirmed in an administrative user identity confirmation step 184, where the second LED 150*b* and the third LED 150*c* are illuminated green and flashed twice. If any of the foregoing steps fails, the third LED 150*c* is illuminated red and flashed twice in an administrative user identity enrollment failure step 186. Although the input steps were repeated three times, it will be appreciated that there may be more or less biometric image input steps depending on the capabilities of the image array sensor 38 and the biometric input controller 62, and how many biometric images must be stored with each identity to reach acceptable speed and accuracy benchmarks.

After configuring one administrative user identity, additional user identities may be configured in an administrative mode, which is another one of the operating states of the system controller 135 mentioned previously. The administrative mode has a first submode for enrolling new user identities. It is possible to set up additional administrative user identities as well as additional standard user identities. More than one identity can be associated with a single user for minimizing the possibility of a misidentification-based lockout. The total number of identities stored in the memory 64 is limited by its capacity, and in one variation, the total number is twenty identities, though this is by way of example only and not of limitation. With reference to the flowchart of FIG. 11, another aspect of the present disclosure involves a method for managing user identities for the locking system 10.

Figure 11:
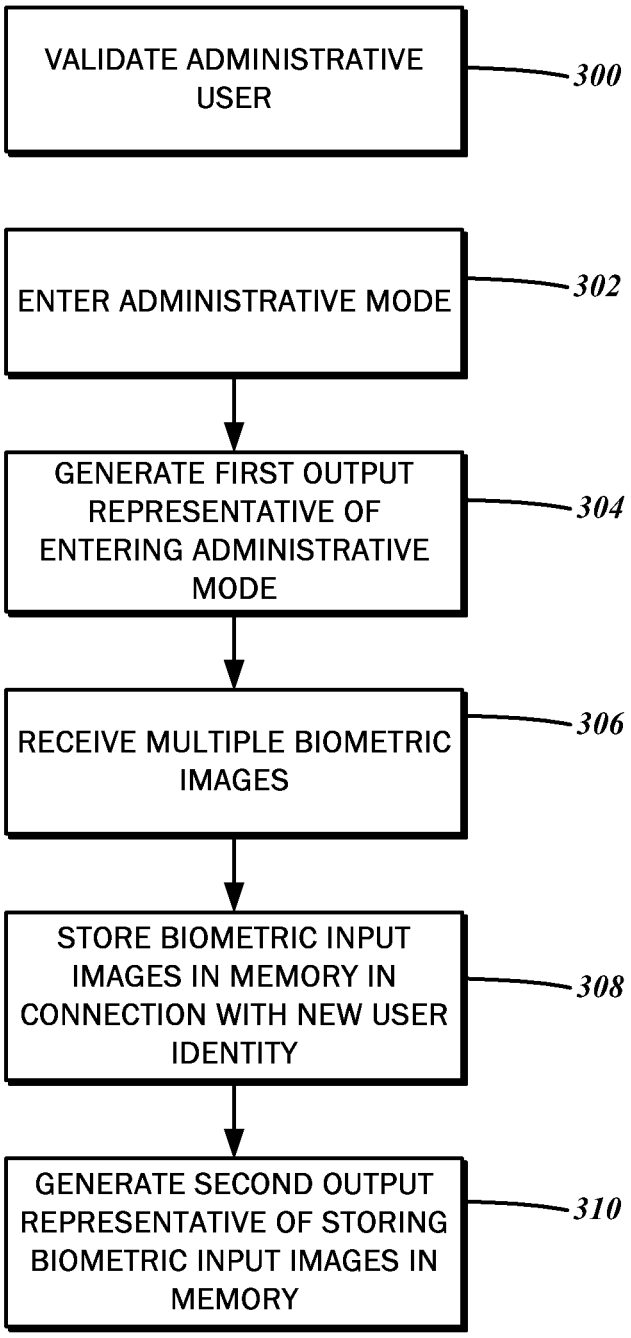
FIG. 11 is a flowchart illustrating one embodiment of a method for managing user identities for a biometric locking system of a firearm.
Figure 12:
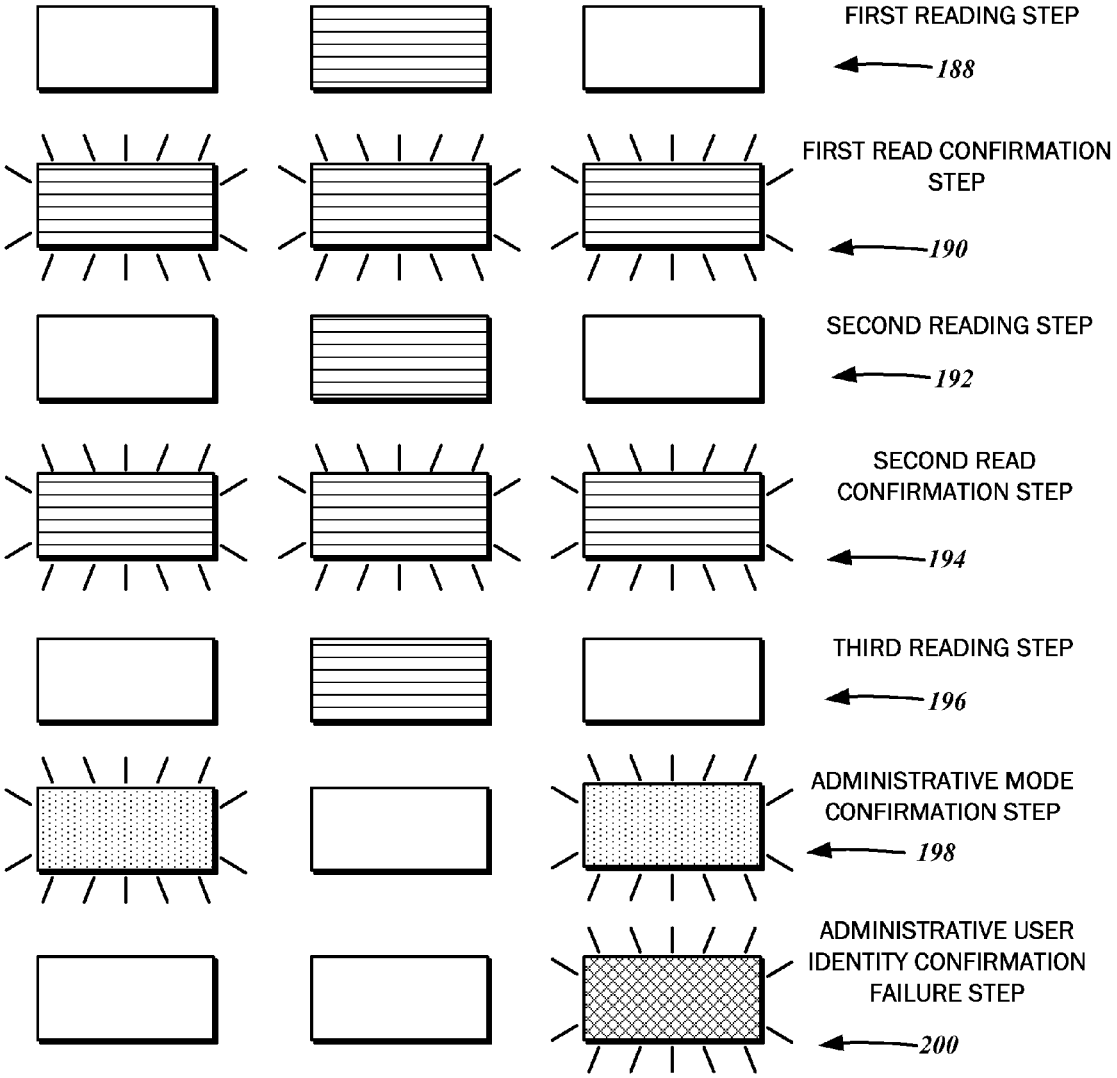
FIG. 12 shows the user interface in a sequence for validating an administrative user.

The method may begin with validating the administrative user based upon multiple comparisons of a plurality of input biometric feature data sets of the physiological feature received on the imaging array sensor 38 to a stored biometric image corresponding to the identity of the administrative user. With further reference to FIG. 12, the administrative user places the finger on the imaging array sensor 38, and the second LED 150*b* is illuminated green during a reading step 188. Upon confirming that there is a match to an existing identity, each of the LEDs 150*a*-150*c* are illuminated green and flash twice per successful first read confirmation step 190. The finger is to be maintained on the imaging array sensor 38 until the second LED 150*b* is illuminated green. The finger is released from the imaging array sensor 38, and rescanned in a second reading step 192. Again, after confirming the match, each of the LEDs 150*a*-150*c* are illuminated green and flash twice per successful first read confirmation step 194. When the second LED 150*b* is illuminated green, the finger is released, with the process being repeated a third time with a third reading step 196. As shown in the flowchart of FIG. 11, upon confirming the input biometric feature data set at this point, the system controller 136 enters the administrative mode per step 302. The first LED 150*a* and the third LED 150*c* are illuminated yellow and flashed twice in an administrative mode confirmation step 198. This is understood to correspond to step 304 of generating a first output that is representative of entering the administrative mode. If any of the foregoing steps fails, the third LED 150*c* is illuminated red and flashed twice in an administrative user identity confirmation failure step 200. Although the input steps were repeated three times, this is by way of example only and not of limitation. Those having ordinary skill in the art will recognize that there may be more or less than described herein.

Figure 13:
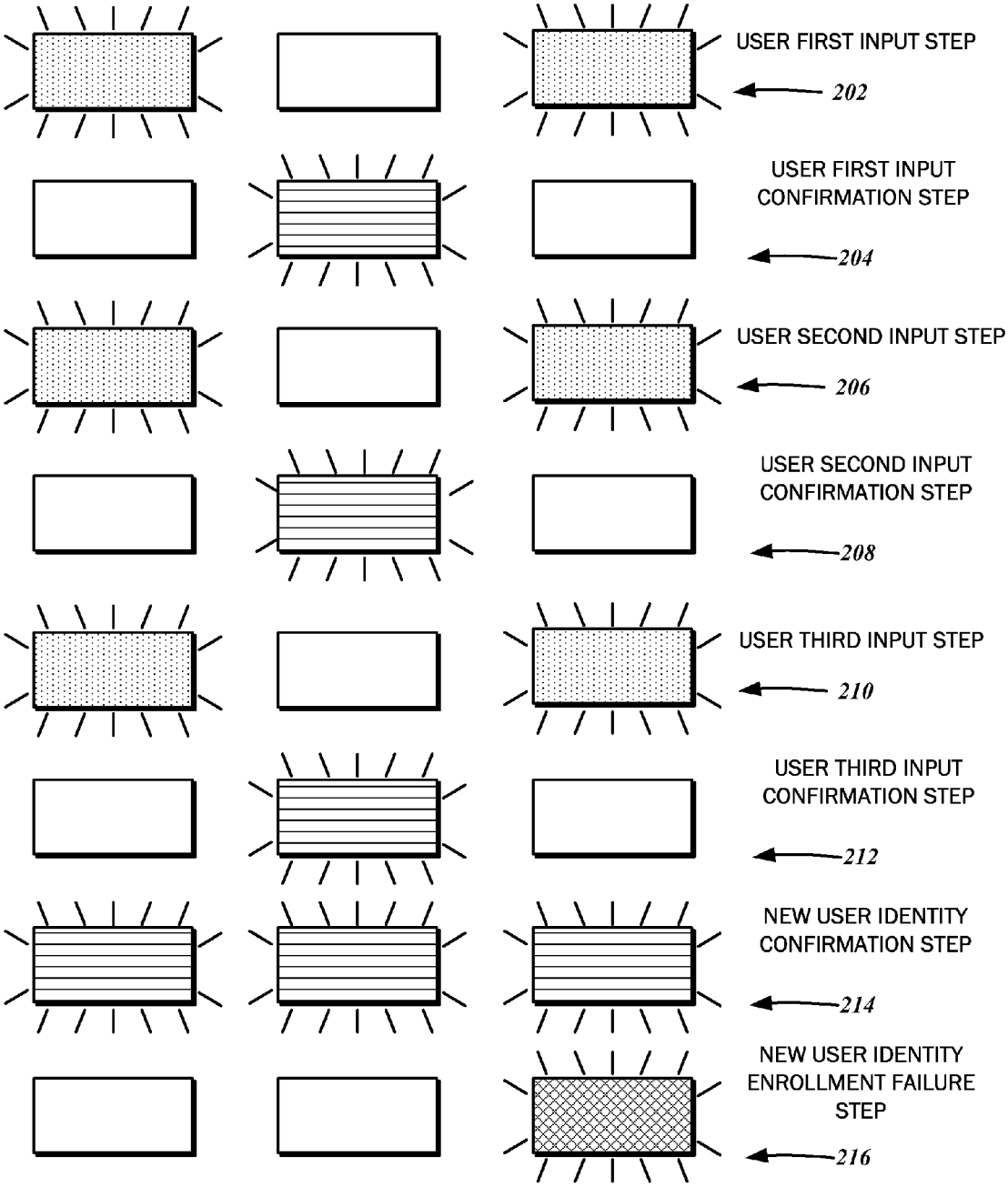
FIG. 13 shows the user interface in a sequence for enrolling a new user.

After entering the administrative mode and generating a confirmation of the same, the method continues with receiving, on the imaging array sensor 38, multiple input biometric feature data sets of the physiological feature associated with a new user identity in accordance with step 306. This is substantially the same procedure as enrolling the administrative user for the first time as discussed above. As shown in FIG. 13 in a user first input step 202, the first LED 150*a* and the third LED 150*c* are illuminated yellow and flashing, waiting for the user to place the finger. While processing the input biometric feature data set received thereby, the second LED 150*b* is illuminated green and flashed once to indicate success in a user first input confirmation step 204. The first LED 150*a* and the third LED 150*c* are again illuminated yellow and flashing and waits for the user to release the finger and place again in a user second input step 206. While processing the input biometric feature data set, the second LED 150*b* is illuminated green and flashed once to indicate success in a user second input confirmation step 208. This is repeated a third time, and the first LED 150*a* and the third LED 150*c* are illuminated yellow and flashing while waiting for the user to release and re-place the finger in a user third input step 210. Upon acceptance, the second LED 150*b* is illuminated green and flashed once to indicate success in an user third input confirmation step 212. As also shown in the flowchart of FIG. 11, the new user identity is associated with the three received input biometric feature data sets and stored in the memory 64 per step 308, and this is confirmed in a new user identity confirmation step 214, where the second LED 150*b* and the third LED 150*c* are illuminated green and flashed twice. This corresponds to step 310 of generating a second output representative of storing the multiple input biometric feature data sets for the new user identity. If any of the foregoing steps fails, the third LED 150*c* is illuminated red and flashed twice in a new user identity enrollment failure step 216. While the biometric image of the new user identity was read three times, depending on the accuracy and speed desired, there may be more or less readings.

Figure 14:
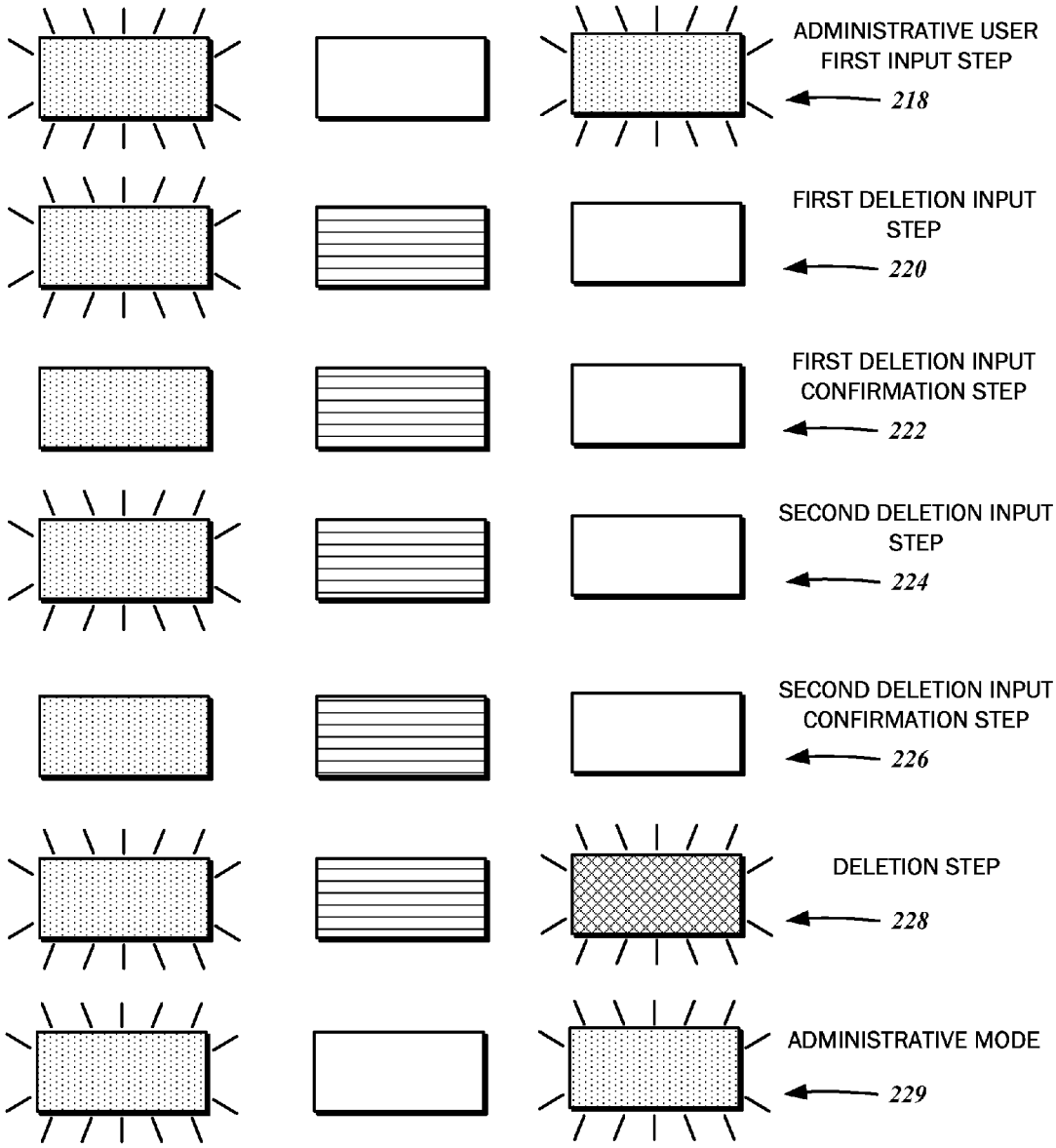
FIG. 14 shows the user interface in a sequence for deleting enrolled users from the biometric locking system.

The present disclosure also contemplates the deletion of users by the administrative user, and so the system controller 136 enters a deletion submode therefor. With reference to FIG. 14, after entering the administrative mode in the manner discussed above, the first LED 150*a* and the third LED 150*c* are illuminated yellow and flashing, waiting for the user to place the finger in an administrative user first input step 218. Recognized as being associated with the same administrative user that initiated the entry into the administrative mode, the first LED 150*a* is illuminated yellow and the second LED 150*b* is illuminated green, and both are flashed twice in a first deletion input step 220. The finger is removed from the imaging array sensor 38, and the first LED 150*a* illuminated yellow and the second LED 150*b* illuminated green is maintained in that condition in a first deletion input confirmation step 222. At this point, the finger is placed on the imaging array sensor 38 again, thus transitioning to a second deletion input step 224 where the first LED 150*a* illuminated yellow and the second LED 150*b* illuminated green are flashed twice. Removing the finger from the imaging array sensor 38 at this point then transitions execution to a second deletion input confirmation step 226. Placing the finger on the imaging array sensor 38 is operative to then remove all user identities in the memory 64, with the first LED 150*a* illuminated yellow, the second LED 150*b* illuminated green, and the third LED 150*c* illuminated red, all of which are flashed three times in a deletion step 228. After successful deletion of the user identities, the system controller 136 remains in the administrative mode 229. If any one of the foregoing steps is unsuccessful, no user identities are deleted and the system controller 136 returns to the administrative mode. Although the confirmation steps were repeated two times, this is by way of example only and not of limitation. If additional levels of safeguards are desired to prevent deletion, the number of confirmations may be increased.

The user enrollment and deletion steps described above are used in a standalone configuration in which the sole input modality is the imaging array sensor 38. According to some embodiments, these steps may be performed via an external setup module such as a personal computer that is in communication with the biometric input controller 62. Instead of the limited outputs on the LEDs 150, the requested actions and status indications may be generated in text form on the external setup module. As shown in the block diagram of FIG. 2, there is an external data communications connector 230 that is mounted to a lower corner of the circuit board 58. This connector is understood to be of a Mini-USB (Universal Serial Bus) type, though any other data communications modality and connectors specific thereto may be utilized, such as Micro-USB.

The external data communications connector 230 serves a dual purpose of providing electrical power to the locking system 10. More particularly, as best illustrated in FIG. 3 and FIG. 4, the locking system 10 is normally powered by a battery 232 that is disposed on the right side 46 of the grip 27, underneath the right grip panel 50. Under typical operating conditions, electrical power for the locking system is provided solely by the battery 232. However, with the connector 230 being connected to an external power source, a charging circuit 234 directs electrical power to the battery 232 to charge the same.

Figure 15:
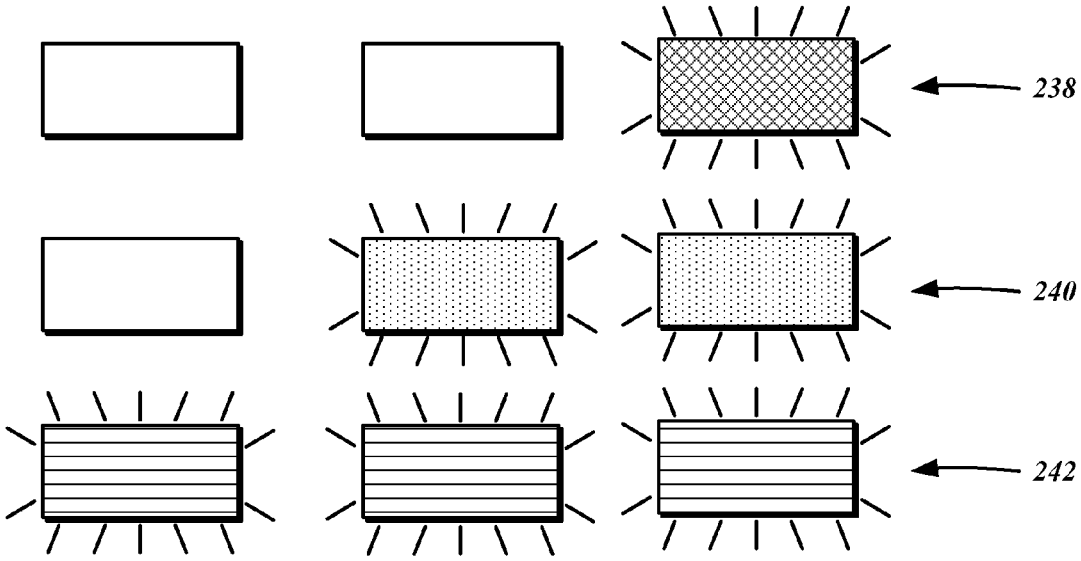
FIG. 15 shows a first embodiment of the user interface in a charging/storage mode.
Figure 16:
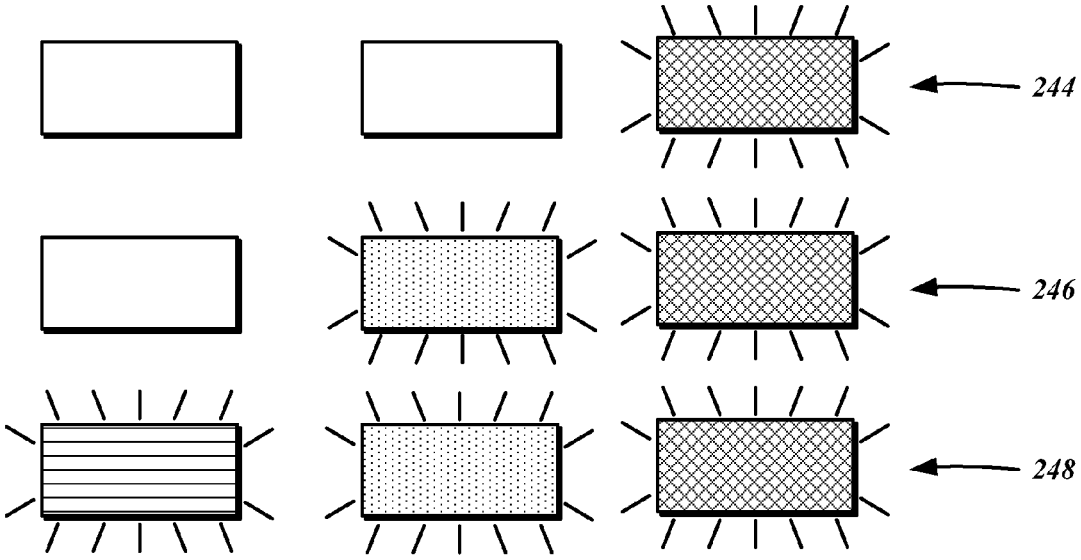
FIG. 16 shows a second embodiment of the user interface in a charging/storage mode.

The power level of the battery 232 and its charging status is monitored by a charging control circuit 236, which provides data thereof to the system controller 136. This data is utilized to generate outputs to the LEDs to visually represent available power levels. FIG. 15 illustrates one contemplated embodiment in which the third LED 150*c* is illuminated red and flashing while the battery is being charged and still at a low level per condition 238. The second LED 150*b* and the third LED 150*c* are illuminated yellow and flashing while the battery is charging at a medium power level in condition 240. The first LED 150*a*, the second LED 150*b*, and the third LED 150*c* are illuminated green and flashing while the battery is charging at a high power level in condition 242. In an alternative embodiment shown in FIG. 16, the third LED 150*c* is illuminated red and flashing while the battery is being charged and at a lower power level in condition 244. When the battery is charging and at a medium power level in condition 246, the second LED 150*b* is illuminated yellow and flashing, and the third LED 150*c* remains illuminated red and flashing. When the battery is charging and at a high power level per condition 248, the first LED 150*a* is illuminated green and flashing, the second LED 150*b* remains illuminated yellow and flashing, and the third LED 150*c* remains illuminated red and flashing. It will be recognized by those having ordinary skill in the art that different representations of the charging status may be substituted without departing from the scope of the present disclosure.

The locking system 10 is remains powered for an extended period of time without being charged by an external power source. Specifically, locking system 10 remains in a state in which the lock 72 can be unset for up to one year without recharging, and thus draws nearly zero standby idle current. The locking system 10 includes the power switching circuit 250 that interfaces the battery 232 to the rest of the circuitry, and cuts power components when deemed non-essential for that particular operating state. For example, in the idle state, the LEDs 150 are shut off, the proximity sensor need not generate a reflecting signal, and the accelerometer need not generate orientation indicator signals. As mentioned above, the imaging array sensor 38 is a capacitive type, and minimal power thereto can be supplied while retaining sensing capabilities that permit it to act as a power switch. The disclosed switch 65 also operates as a power switch. Further, as different components require different voltages, the power switching circuit 250 derives different voltage levels from the battery 232 for delivery the components. Most components including the biometric input controller 62, the proximity sensor 66, the accelerometer 70, select portions of the lock controller circuit 130, the LEDs 150, and the charging control circuit 236 uses 3.3V, while the motor driver circuitry in the lock controller circuit 130 utilizes 6V.

When the power level is within the 80% to 20% range, it is contemplated that 500 unlock/relock cycles are possible. When the power level get to below 20% or some other predetermined threshold, the LEDs 150, and specifically the third LED 150*c*, can be illuminated red and flashed to warn of this condition. One of the inputs of the system controller 136 can be connected to the output of a battery status monitor circuit 252 that checks the power level of the battery 232. The battery level may be checked during an unlock/relock cycle, with the third LED 150*c* also being illuminated at such time for a limited period. In some situations, the battery level may be checked outside of the unlock/relock cycle as well.

The particulars shown herein are by way of example and for purposes of illustrative discussion of the embodiments of the present disclosure only and are presented in the cause of providing what is believed to be the most useful and readily understood description of the principles and conceptual aspects. In this regard, no attempt is made to show details of the present invention with more particularity than is necessary, the description taken with the drawings making apparent to those skilled in the art how the several forms of the present invention may be embodied in practice.

What is claimed is:

1. A lock for a firearm with a grip safety, and a sear engageable to a biased hammer in a cocked position and releasable by a trigger, the lock comprising:

a housing defining a first bore within which a mainspring that biases the hammer is received, and a second bore;

a locking pin retractable into and extendible out of the second bore of the housing, the locking pin in an extended position restricting the grip safety to an engaged state, blocking movement of the trigger;

an actuator disposed in the housing and cooperatively linked to the locking pin, the actuator providing the motive force for retracting and extending the locking pin.

2. The lock of claim 1, wherein the locking pin in a retracted position allows the grip safety to be depressed to a disengaged state unblocking movement of the trigger.

3. The lock of claim 1, wherein the actuator is electromechanical and extends and retracts the locking pin based upon an electronic signal.

4. The lock of claim 3, wherein the actuator is a planetary geared servo motor.

5. The lock of claim 3, further comprising:

an electrical connector attached to the housing.

6. The lock of claim 1, wherein the actuator includes a telescoping shaft coupled to the locking pin.

7. The lock of claim 1, wherein the housing is defined by a top end and an opposed bottom end, with the openings corresponding to the first bore and the second bore are defined by the top end.

8. The lock of claim 1, wherein the housing is received onto a frame of the firearm.

9. The lock of claim 1, further comprising:

an external override latch cooperatively engageable to the locking pin in a first position, blocking movement thereof.

10. The lock of claim 9, wherein engagement and disengagement of the external override latch is restricted to a key.

11. A firearm, comprising:

a frame;

a hammer pivotally mounted to the frame and defining at least one sear engagement surface corresponding to a cocked position and a firing pin striking surface;

a hammer strut linked to the hammer;

a sear pivotally mounted to the frame and defining a hammer engagement surface frictionally engaged to the sear engagement surface of the hammer;

a disconnector selectively engageable to the sear;

a trigger including a trigger bar in frictional engagement with the disconnector;

a mainspring housing assembly attached to the frame and defining a first bore receptive to a mainspring and a mainspring cap, the hammer strut being retained in the mainspring cap in compression against the biasing of the mainspring and the hammer in the cocked position being resultantly biased against the sear, movement of the trigger bar against the sear releasing the hammer from the sear;

a safety latch having a set position blocking movement of the sear;

a grip safety including a trigger stop with a released position blocking movement of the trigger bar and a depressed position allowing movement of the trigger bar; and a secondary lock including an locking pin having a first position extending from the mainspring housing and a second position retracted within the mainspring housing, the pin blocking movement of the grip safety in the first position and permitting movement of the grip safety in the second position.

12. The firearm of claim 11, wherein the secondary lock further includes a key-based override latch selectively obstructing the extension of the plunger.

13. The firearm of claim 11, further comprising:

an electromechanical actuator cooperatively linked to the locking pin, the actuator extending the plunger to the first position based upon a first electronic signal and retracting the plunger to the second position based upon a second electronic signal.

14. The firearm of claim 13, wherein the electromechanical actuator is a planetary geared servo motor.

15. The firearm of claim 14, wherein the electromechanical actuator includes a telescoping shaft coupled to the locking pin.

16. The firearm of claim 13, further comprising:

a lock controller module in communication with the electromechanical actuator, the lock controller generating the first electronic signal in response to a first input condition received by the lock controller module and generating the second electronic signal in response to a second condition received by the lock controller module.

* * * * *